US006294720B1

(12) United States Patent
Aoki

(10) Patent No.: US 6,294,720 B1
(45) Date of Patent: Sep. 25, 2001

(54) APPARATUS AND METHOD FOR CREATING MELODY AND RHYTHM BY EXTRACTING CHARACTERISTIC FEATURES FROM GIVEN MOTIF

(75) Inventor: Eiichiro Aoki, Shizuoka-ken (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/500,278

(22) Filed: Feb. 8, 2000

(30) Foreign Application Priority Data

Feb. 8, 1999 (JP) ..... 11-030685

(51) Int. Cl.[7] ..... G10H 1/40; G10H 1/42

(52) U.S. Cl. ..... 84/611; 84/635; 84/651; 84/DIG. 12

(58) Field of Search ..... 84/609–614, 634–638, 84/649–652, 666–669, DIG. 12

(56) References Cited

U.S. PATENT DOCUMENTS 4,926,737 * 5/1990 Minamitaka ..... 84/611
5,113,744 * 5/1992 Tanaka et al. ..... 84/634
5,155,286 * 10/1992 Saito et al. ..... 84/611
5,486,646 * 1/1996 Yamashita et al. ..... 84/635
5,739,456 * 4/1998 Shimada ..... 84/636 X
5,756,917 * 5/1998 Watanabe et al. ..... 84/634

* cited by examiner

*Primary Examiner*—Stanley J. Witkowski
(74) *Attorney, Agent, or Firm*—Rossi & Associates

(57) ABSTRACT

From a given melody motif is extracted a rhythm pattern consisting of a series of rhythmic alignment of notes without a pitch representing the time positions of the notes constituting the melody. Also extracted from the given melody motif are the pitches of the skeleton notes which are notes having primary importance in the rhythm pattern in view of rhythm beats such as the strong beat notes. A rhythm pattern which is similar to the motif rhythm pattern is provided, for example, by searching through a data base including various rhythm patterns. The skeleton notes in the searched similar rhythm pattern are given the pitches identified by the extracted pitches, respectively at corresponding time positions. The non-skeleton notes are given pitches using, for example, passing notes, unison, appoggiatura, changing notes and after notes according to the musical rules relative to the pitch given skeleton notes. Thus, a length of melody similar to the melody motif is obtained. In place of the similar rhythm pattern, a rhythm pattern which is contrastive to the motif rhythm pattern may be provided to obtain a length of melody contrastive to the melody motif.

23 Claims, 9 Drawing Sheets

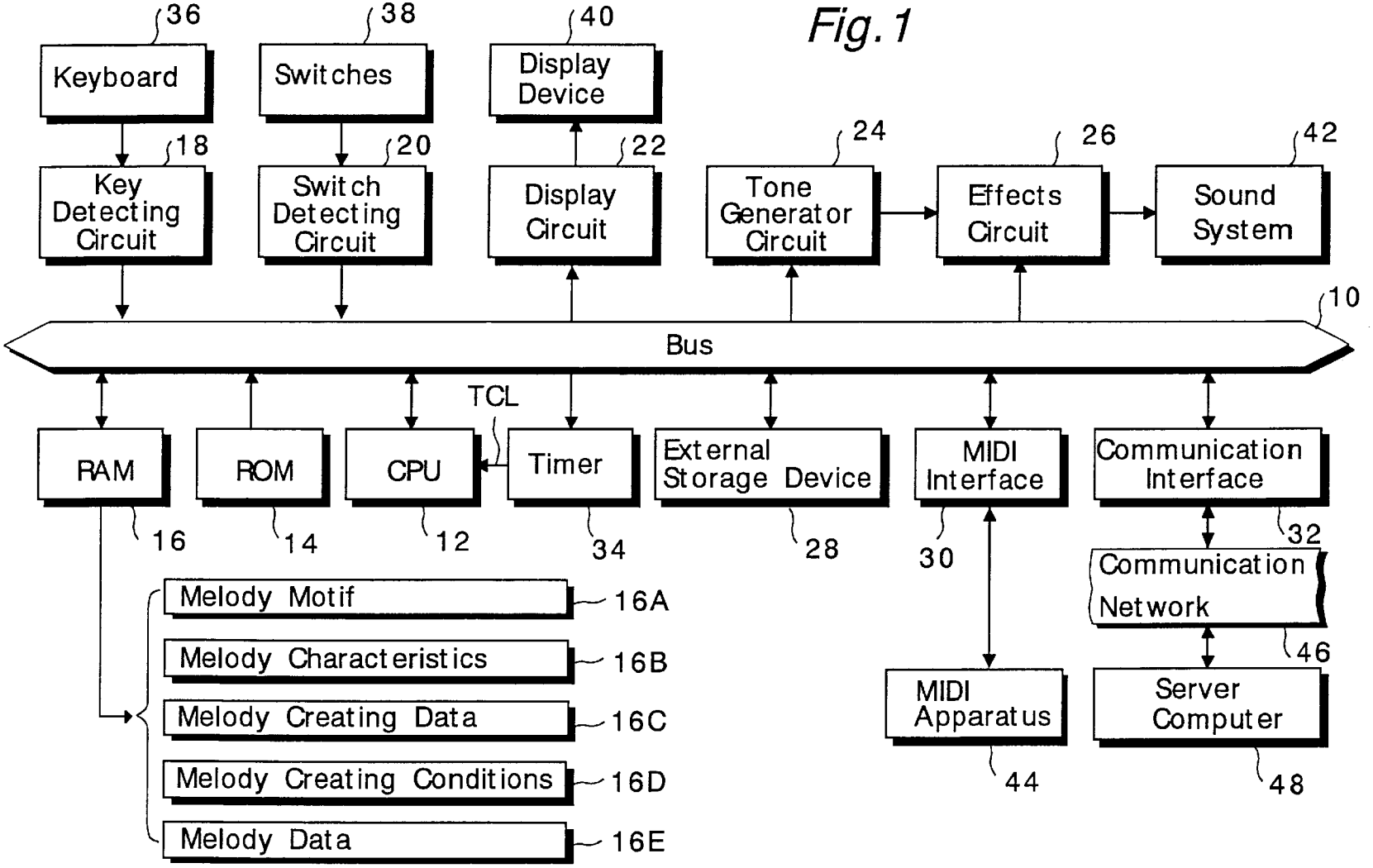
Fig. 1
Keyboard
36
Key Detecting Circuit
18
Switches
38
Switch Detecting Circuit
20
Display Device
40
Display Circuit
22
Tone Generator Circuit
24
Effects Circuit
26
Sound System
42
Bus
10
RAM
16
ROM
14
CPU
12
TCL
Timer
34
External Storage Device
28
MIDI Interface
30
Communication Interface
32
Communication Network
46
Server Computer
48
MIDI Apparatus
44
Melody Motif
16A
Melody Characteristics
16B
Melody Creating Data
16C
Melody Creating Conditions
16D
Melody Data
16E

*Fig. 7a* Inputted Melody Motif
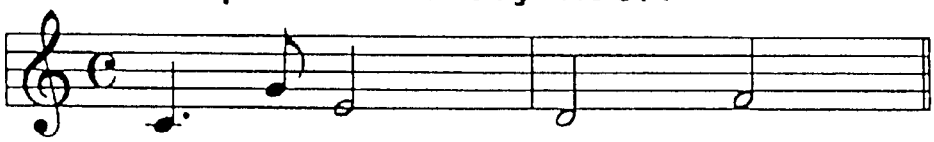
*Fig. 7b* Extracted Strong Beat Notes
$C_4$ $E_4$ $D_4$ $F_4$
*Fig. 7c* Extracted Rhythm Pattern
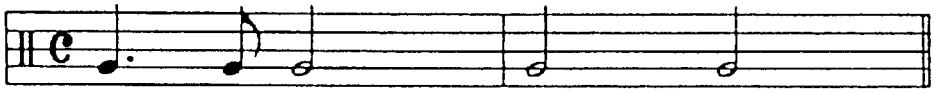
*Fig. 7d* Similar Rhythm Pattern
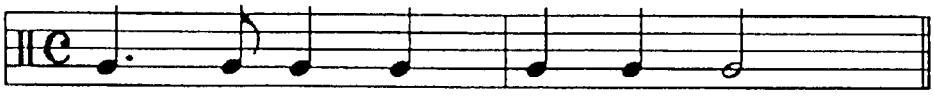
*Fig. 7e* Pitch Imparted Skeleton Notes
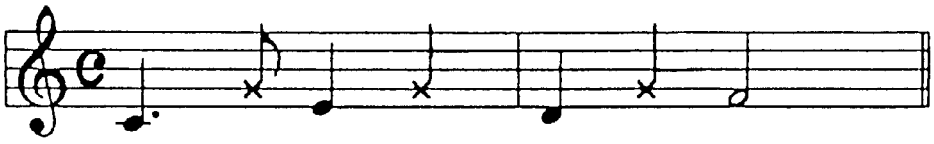

Fig. 7f Pitch Imparted Non-skeleton Notes
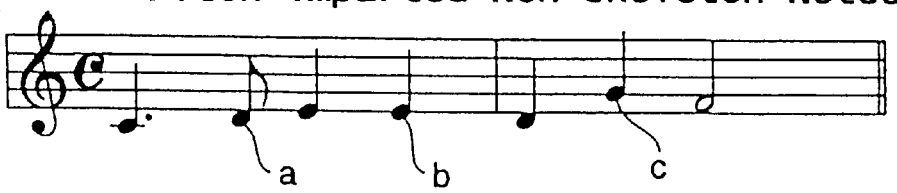
Fig. 7g Contrastive Rhythm Pattern
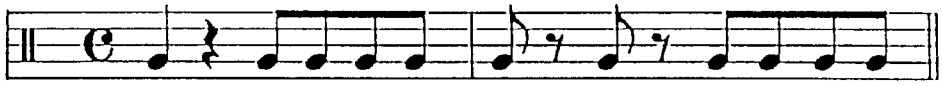
Fig. 7h Pitch Imparted Skeleton Notes
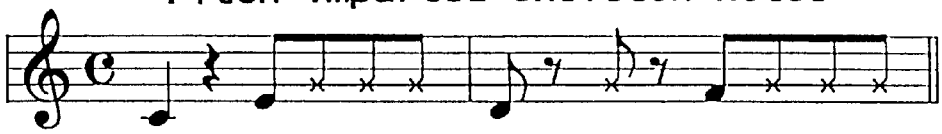
Fig. 7i Pitch Imparted Non-skeleton Notes
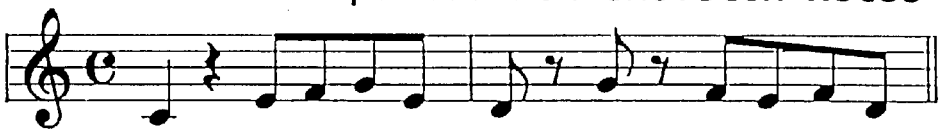

APPARATUS AND METHOD FOR CREATING MELODY AND RHYTHM BY EXTRACTING CHARACTERISTIC FEATURES FROM GIVEN MOTIF

BACKGROUND OF THE INVENTION

1. Field of the Invention

The present invention relates to an apparatus and a method for creating melody pieces and rhythm patterns to be suitable for an automatic music composing apparatus and method, and a machine readable medium containing program instructions for realizing such an apparatus and a method using a computer system, and more particularly to an apparatus and a method capable of extracting a rhythm pattern from a given melody motif and creating melody pieces based on the extracted rhythm pattern and on similar and/or contrastive rhythm patterns, thereby producing a melody with good similarity or good contrast to the given motif melody or producing a rhythm pattern with good similarity or good contrast to the given rhythm pattern. The invention is applicable in various kinds of electronic musical apparatuses such as an electronic musical instrument, an automatic music composing apparatus, and a computer-system-configured music composing apparatus.

2. Description of the Related Invention

The same inventor has previously proposed an automatic music composing apparatus and method for generating melody data of an amount of a tune by inputting a theme melody and extracting from the stored data base such melody generating data that represent the same or similar melody characteristics (or melody itself) as the inputted theme melody, and constructing a melody based on thus extracted melody generating data, and applied for a patent in the U.S. PTO (Ser. No. 09/212,192), which is pending in the U.S. PTO and does not constitute prior art against the present invention. The previous invention is capable of generating a melody which fits the theme melody and has abundant ups and downs.

In the above proposed automatic music composing apparatus, a melody piece for a sentence A' which is similar to a sentence A is obtained by: 1) copying (to be identical) or imitating (to be similar) the first (or second) half melody fraction of the sentence A and paste it to the first (or second) half of the sentence A' and newly creating a melody fraction for the second (or first) half (i.e. the remainder) of the sentence A'; 2) shifting the pitches of the notes in the melody piece of the sentence A to make a melody piece for the sentence A'; and so forth.

Further, a melody piece for a sentence B which is contrastive to a sentence A is obtained by: 3) pitch-inverting the melody of the sentence A with respect to a certain reference pitch to make a melody for the sentence B (e.g. a melody with notes C, D, E and G is inverted into a melody with notes E, D, C, A with respect to the pitch D); 4) changing the density (sparse or dense) distribution of the note in terms of rhythm in the sentence A to make a melody for a sentence B (e.g. in case the note distribution in the first half of the sentence A is sparse and that in the second half of the sentence A is dense, the note distribution for the first half of the sentence B is made dense and that for the second half of the sentence B is made sparse); and so forth.

According to the method 1) above, a newly created melody piece for the second (or first) half of the sentence A' may not always assume a good matching to the copied or imitated melody piece for the first (or second) half of the sentence A'. According to the method 2) above, a pitch-shifted melody from the melody of the sentence A may not highly assume the characteristic features of the original melody. Thus, the obtained melody for the sentence A' may sometimes assume poor musical similarity to the melody of the sentence A.

According to the method 3) or 4) above, a pitch-inverted melody or a note-density-changed melody from the melody of the sentence A may be well different from the original melody of the sentence A but may not always assume a musically good contrast to the melody of the sentence A to be a melody for the sentence B.

SUMMARY OF THE INVENTION

It is, therefore, a primary object of the present invention to provide a novel type of melody creating apparatus and method, and a machine readable medium containing a program therefor capable of creating a melody which assumes a good similarity or a good contrast to a given melody.

It is also an object of the present invention to provide a novel type of rhythm pattern creating apparatus and method, and a machine readable medium containing a program therefor capable of creating a rhythm pattern which assumes a good similarity or a good contrast to a given rhythm pattern.

According to the present invention, the object is accomplished by providing a melody creating apparatus which includes: a melody motif supplying device which supplies a motif melody piece; a melody analyzing device which analyzes the supplied motif melody piece to extract pitch characteristics and a rhythm pattern of the supplied motif melody piece, the extracted rhythm pattern consisting of a series of rhythmic alignment of note time points including skeleton note time points having primary importance in view of rhythm beats and non-skeleton note time points having secondary importance in view of rhythm beats; a pitch imparting device which imparts note pitches to the skeleton note time points in the extracted rhythm pattern, respectively, according to the extracted pitch characteristics to make pitch imparted skeleton notes, and imparts note pitches to the non-skeleton note time points in the extracted rhythm pattern, respectively, according to musical grammar making reference to the pitch imparted skeleton notes to make pitch imparted non-skeleton notes; and a melody producing device which combines the pitch imparted skeleton notes and the pitch imparted non-skeleton notes to produce a length of melody. Being thus structured, the apparatus creates a melody which assumes a good similarity to the supplied melody motif.

According to an aspect of the present invention, a melody creating apparatus includes: a melody motif supplying device which supplies a motif melody piece; a melody analyzing device which analyzes the supplied motif melody piece to extract pitch characteristics and a rhythm pattern of the supplied motif melody piece, the rhythm pattern consisting of a series of rhythmic alignment of note time points; a similar rhythm pattern creating device which creates a rhythm pattern being similar to the extracted rhythm pattern and consisting of a series of rhythmic alignment of note time points including skeleton note time points having primary importance in view of rhythm beats and non-skeleton note time points having secondary importance in view of rhythm beats; a pitch imparting device which imparts note pitches to the skeleton note time points in the similar rhythm pattern, respectively, according to the extracted pitch characteristics to make pitch imparted skeleton notes, and imparts note pitches to the non-skeleton note time points in the similar rhythm pattern, respectively, according to musical grammar making reference to the pitch imparted skeleton notes to make pitch imparted non-skeleton notes; and a melody producing device which combines the pitch imparted skeleton notes and the pitch imparted non-skeleton notes to produce a length of melody. Being thus structured, the apparatus creates a melody which assumes a further good similarity to the supplied melody motif.

In the above aspect of the present invention, the similar rhythm pattern creating device includes: a storing device which stores plural groups of rhythm patterns in which each one group contains a plurality of rhythm patterns which are similar to each other; a detecting device which detects, among the plural groups of rhythm patterns, a rhythm pattern which is identical with the extracted rhythm pattern; and a reading device which selectively reads out any other rhythm pattern than the detected rhythm pattern from the rhythm pattern group to which the detected rhythm pattern belongs, the read-out rhythm pattern being employed as the created similar rhythm pattern. Thus, a further better similar rhythm pattern will be selected and employed for creating a similar melody.

According to another aspect of the present invention, a melody creating apparatus includes: a melody motif supplying device which supplies a motif melody piece; a melody analyzing device which analyzes the supplied motif melody piece to extract a rhythm pattern of the supplied motif melody piece, the rhythm pattern consisting of a series of rhythmic alignment of note time points; a contrastive rhythm pattern creating device which creates a rhythm pattern being contrastive to the extracted rhythm pattern and consisting of a series of rhythmic alignment of note time points including skeleton note time points having primary importance in view of rhythm beats and non-skeleton note time points having secondary importance in view of rhythm beats; a pitch providing device which provides pitch information deciding pitches to be imparted to the skeleton notes; a pitch imparting device which imparts note pitches to the skeleton note time points in the contrastive rhythm pattern, respectively, according to the provided pitch information to make pitch imparted skeleton notes, and imparts note pitches to the non-skeleton note time points in the contrastive rhythm pattern, respectively, according to musical grammar making reference to the pitch imparted skeleton notes to make pitch imparted non-skeleton notes; and a melody producing device which combines the pitch imparted skeleton notes and the pitch imparted non-skeleton notes to produce a length of melody. Being thus structured, the apparatus creates a melody which assumes a good contrast to the supplied melody motif.

In the above aspect of the present invention, the contrastive rhythm pattern creating device includes: a storing device which stores plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a detecting device which detects, among the first plural groups of rhythm patterns, a rhythm pattern which is identical with the extracted rhythm pattern; and a reading device which selectively reads out a rhythm pattern from the second rhythm pattern attendant to the group to which the detected rhythm pattern belongs, the read-out rhythm pattern being employed as the created contrastive rhythm pattern. Thus, a further better contrastive rhythm pattern will be selected and employed for creating a contrastive melody.

According to a further aspect of the present invention, a melody creating apparatus includes: a melody motif supplying device which supplies a motif melody piece; a melody analyzing device which analyzes the supplied motif melody piece to extract a rhythm pattern of the supplied motif melody piece; a storing device which stores plural groups of rhythm patterns in which each one group contains a plurality of rhythm patterns which are similar to each other; a detecting device which detects, among the plural groups of rhythm patterns, a rhythm pattern which is identical with the extracted rhythm pattern; a reading device which selectively reads out any other rhythm pattern than the detected rhythm pattern from the rhythm pattern group to which the detected rhythm pattern belongs; and a melody producing device which produces a length of melody which assumes similarity to the melody motif based on the read-out rhythm pattern from the reading device. Being thus structured, the apparatus creates a melody which assumes a good similarity to the supplied melody motif.

According to a further aspect of the present invention, a melody creating apparatus includes: a melody motif supplying device which supplies a motif melody piece; a melody analyzing device which analyzes the supplied motif melody piece to extract a rhythm pattern of the supplied motif melody piece; a storing device which stores plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a detecting device which detects, among the first plural groups of rhythm patterns, a rhythm pattern which is identical with the extracted rhythm pattern; a reading device which selectively reads out a rhythm pattern from the second rhythm pattern attendant to the group to which the detected rhythm pattern belongs; and a melody producing device which produces a length of melody which assumes contrastiveness to the melody motif based on the read-out rhythm pattern from the reading device. Being thus structured, the apparatus creates a melody which assumes a good contrast to the supplied melody motif.

According to the present invention, the object is further accomplished by providing a rhythm pattern creating apparatus which includes: a rhythm pattern supplying device which supplies a rhythm pattern piece; a storing device which stores plural groups of rhythm patterns in which each one group contains a plurality of rhythm patterns which are similar to each other; a detecting device which detects, among the plural groups of rhythm patterns, a rhythm pattern which is identical with the supplied rhythm pattern; a reading device which selectively reads out any other rhythm pattern than the detected rhythm pattern from the rhythm pattern group to which the detected rhythm pattern belongs; and a rhythm pattern producing device which produces a length of rhythm pattern which assumes similarity to the supplied rhythm pattern based on the read-out rhythm pattern from the reading device. Being thus structured, the apparatus creates a rhythm pattern which assumes a good similarity to the supplied rhythm pattern.

According to a further aspect of the present invention, a rhythm pattern creating apparatus includes: a rhythm pattern supplying device which supplies a rhythm pattern piece; a storing device which stores plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a detecting device which detects, among the first plural groups of rhythm patterns, a rhythm pattern which is identical with the supplied pattern; a reading device which selectively reads out a rhythm pattern from the second rhythm pattern attendant to the group to which the detected rhythm pattern belongs; and a rhythm pattern producing device which produces a length of rhythm pattern which assumes contrastiveness to the supplied rhythm pattern based on the read-out rhythm pattern from the reading device. Being thus structured, the apparatus creates a rhythm pattern which assumes a good contrast to the supplied rhythm pattern.

According to the present invention, the object is further accomplished by providing a method for creating a melody which method includes: a step of supplying a motif melody piece; a step of analyzing the supplied motif melody piece to extract pitch characteristics and a rhythm pattern of the supplied motif melody piece, the extracted rhythm pattern consisting of a series of rhythmic alignment of note time points including skeleton note time points having primary importance in view of rhythm beats and non-skeleton note time points having secondary importance in view of rhythm beats; a step of imparting note pitches to the skeleton note time points in the extracted rhythm pattern, respectively, according to the extracted pitch characteristics to make pitch imparted skeleton notes, and imparts note pitches to the non-skeleton note time points in the extracted rhythm pattern, respectively, according to musical grammar making reference to the pitch imparted skeleton notes to make pitch imparted non-skeleton notes; and a step of combining the pitch imparted skeleton notes and the pitch imparted non-skeleton notes to produce a length of melody. Being thus practiced, the method creates a melody which assumes a good similarity to the supplied melody motif.

According to a still further aspect of the present invention, a method for creating a melody includes: a step of supplying a motif melody piece; a step of analyzing the supplied motif melody piece to extract pitch characteristics and a rhythm pattern of the supplied motif melody piece, the rhythm pattern consisting of a series of rhythmic alignment of note time points; a step of creating a rhythm pattern being similar to the extracted rhythm pattern and consisting of a series of rhythmic alignment of note time points including skeleton note time points having primary importance in view of rhythm beats and non-skeleton note time points having secondary importance in view of rhythm beats; a step of imparting note pitches to the skeleton note time points in the similar rhythm pattern, respectively, according to the extracted pitch characteristics to make pitch imparted skeleton notes, and imparting note pitches to the non-skeleton note time points in the similar rhythm pattern, respectively, according to musical grammar making reference to the pitch imparted skeleton notes to make pitch imparted non-skeleton notes; and a step of combining the pitch imparted skeleton notes and the pitch imparted non-skeleton notes to produce a length of melody. Being thus practiced, the method creates a melody which assumes a further good similarity to the supplied melody motif.

According to a still further aspect of the present invention, a method for creating a melody includes: a step of supplying a motif melody piece; a step of analyzing the supplied motif melody piece to extract a rhythm pattern of the supplied motif melody piece, the rhythm pattern consisting of a series of rhythmic alignment of note time points; a step of creating a rhythm pattern being contrastive to the extracted rhythm pattern and consisting of a series of rhythmic alignment of note time points including skeleton note time points having primary importance in view of rhythm beats and non-skeleton note time points having secondary importance in view of rhythm beats; a step of providing pitch information deciding pitches to be imparted to the skeleton notes; a step of imparting note pitches to the skeleton note time points in the contrastive rhythm pattern, respectively, according to the provided pitch information to make pitch imparted skeleton notes, and imparting note pitches to the non-skeleton note time points in the contrastive rhythm pattern, respectively, according to musical grammar making reference to the pitch imparted skeleton notes to make pitch imparted non-skeleton notes; and a step of combining the pitch imparted skeleton notes and the pitch imparted non-skeleton notes to produce a length of melody. Being thus practiced, the method creates a melody which assumes a good contrast to the supplied melody motif.

According to a still further aspect of the present invention, a method for creating a melody includes: a step of supplying a motif melody piece; a step of analyzing the supplied motif melody piece to extract a rhythm pattern of the supplied motif melody piece; a step of storing plural groups of rhythm patterns in which each one group contains a plurality of rhythm patterns which are similar to each other; a step of detecting, among the plural groups of rhythm patterns, a rhythm pattern which is identical with the extracted rhythm pattern; a step of selectively reading out any other rhythm pattern than the detected rhythm pattern from the rhythm pattern group to which the detected rhythm pattern belongs; and a step of producing a length of melody which assumes similarity to the melody motif based on the read-out rhythm pattern at the step of reading. Being thus practiced, the method creates a melody which assumes a good similarity to the supplied melody motif.

According to a still further aspect of the present invention, a method for creating a melody includes: a step of supplying a motif melody piece; a step of analyzing the supplied motif melody piece to extract a rhythm pattern of the supplied motif melody piece; a step of storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a step of detecting, among the first plural groups of rhythm patterns, a rhythm pattern which is identical with the extracted rhythm pattern; a step of selectively reading out a rhythm pattern from the second rhythm pattern attendant to the group to which the detected rhythm pattern belongs; and a step of producing a length of melody which assumes contrastiveness to the melody motif based on the read-out rhythm pattern at the step of reading. Being thus practiced, the method creates a melody which assumes a good contrast to the supplied melody motif.

According to the present invention, the object is further accomplished by providing a method for creating a rhythm pattern which method includes: a step of supplying a rhythm pattern piece; a step of storing plural groups of rhythm patterns in which each one group contains a plurality of rhythm patterns which are similar to each other; a step of detecting, among the plural groups of rhythm patterns, a rhythm pattern which is identical with the supplied rhythm pattern; a step of selectively reading out any other rhythm pattern than the detected rhythm pattern from the rhythm pattern group to which the detected rhythm pattern belongs; and a step of producing a length of rhythm pattern which assumes similarity to the supplied rhythm pattern based on the read-out rhythm pattern at the step of reading. Being thus practiced, the method creates a rhythm pattern which assumes a good similarity to the supplied rhythm pattern.

According to a still further aspect of the present invention, a method for creating a rhythm pattern includes: a step of supplying a rhythm pattern piece; a step of storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a step of detecting, among the first plural groups of rhythm patterns, a rhythm pattern which is identical with the supplied pattern; a step of selectively reading out a rhythm pattern from the second rhythm pattern attendant to the group to which the detected rhythm pattern belongs; and a step of producing a length of rhythm pattern which assumes contrastiveness to the supplied rhythm pattern based on the read-out rhythm pattern from the reading device. Being thus practiced, the method creates a rhythm pattern which assumes a good contrast to the supplied rhythm pattern.

According to the present invention, the object is still further accomplished by providing a storage medium storing a program that is executable by a computer, which program contains: a module for supplying a motif melody piece; a module for analyzing the supplied motif melody piece to extract pitch characteristics and a rhythm pattern of the supplied motif melody piece, the extracted rhythm pattern consisting of a series of rhythmic alignment of note time points including skeleton note time points having primary importance in view of rhythm beats and non-skeleton note time points having secondary importance in view of rhythm beats; a module for imparting note pitches to the skeleton note time points in the extracted rhythm pattern, respectively, according to the extracted pitch characteristics to make pitch imparted skeleton notes, and imparts note pitches to the non-skeleton note time points in the extracted rhythm pattern, respectively, according to musical grammar making reference to the pitch imparted skeleton notes to make pitch imparted non-skeleton notes; and a module for combining the pitch imparted skeleton notes and the pitch imparted non-skeleton notes to produce a length of melody. Using thus arranged program, the computer creates a melody which assumes a good similarity to the supplied melody.

According to a still further aspect of the present invention, a storage medium stores a program that is executable by a computer and contains: a module for supplying a motif melody piece; a module for analyzing the supplied motif melody piece to extract pitch characteristics and a rhythm pattern of the supplied motif melody piece, the rhythm pattern consisting of a series of rhythmic alignment of note time points; a module for creating a rhythm pattern being similar to the extracted rhythm pattern and consisting of a series of rhythmic alignment of note time points including skeleton note time points having primary importance in view of rhythm beats and non-skeleton note time points having secondary importance in view of rhythm beats; a module for imparting note pitches to the skeleton note time points in the similar rhythm pattern, respectively, according to the extracted pitch characteristics to make pitch imparted skeleton notes, and imparting note pitches to the non-skeleton note time points in the similar rhythm pattern, respectively, according to musical grammar making reference to the pitch imparted skeleton notes to make pitch imparted non-skeleton notes; and a module for combining the pitch imparted skeleton notes and the pitch imparted non-skeleton notes to produce a length of melody. Using thus arranged program, the computer creates a melody which assumes a further good similarity to the supplied melody.

According to a still further aspect of the present invention, a storage medium stores a program that is executable by a computer and contains: a module for supplying a motif melody piece; a module for analyzing the supplied motif melody piece to extract a rhythm pattern of the supplied motif melody piece, the rhythm pattern consisting of a series of rhythmic alignment of note time points; a module for creating a rhythm pattern being contrastive to the extracted rhythm pattern and consisting of a series of rhythmic alignment of note time points including skeleton note time points having primary importance in view of rhythm beats and non-skeleton note time points having secondary importance in view of rhythm beats; a module for providing pitch information deciding pitches to be imparted to the skeleton notes; a module for imparting note pitches to the skeleton note time points in the contrastive rhythm pattern, respectively, according to the provided pitch information to make pitch imparted skeleton notes, and imparting note pitches to the non-skeleton note time points in the contrastive rhythm pattern, respectively, according to musical grammar making reference to the pitch imparted skeleton notes to make pitch imparted non-skeleton notes; and a module for combining the pitch imparted skeleton notes and the pitch imparted non-skeleton notes to produce a length of melody. Using thus arranged program, the computer creates a melody which assumes a good contrast to the supplied melody.

According to a still further aspect of the present invention, a storage medium stores a program that is executable by a computer and contains: a module for supplying a motif melody piece; a module for analyzing the supplied motif melody piece to extract a rhythm pattern of the supplied motif melody piece; a module for storing plural groups of rhythm patterns in which each one group contains a plurality of rhythm patterns which are similar to each other; a module for detecting, among the plural groups of rhythm patterns, a rhythm pattern which is identical with the extracted rhythm pattern; a module for selectively reading out any other rhythm pattern than the detected rhythm pattern from the rhythm pattern group to which the detected rhythm pattern belongs; and a module for producing a length of melody which assumes similarity to the melody motif based on the read-out rhythm pattern by the module for reading. Using thus arranged program, the computer creates a melody which assumes a good similarity to the supplied melody.

According to a still further aspect of the present invention, a storage medium stores a program that is executable by a computer and contains: a module for supplying a motif melody piece; a module for analyzing the supplied motif melody piece to extract a rhythm pattern of the supplied motif melody piece; a module for storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a module for detecting, among the first plural groups of rhythm patterns, a rhythm pattern which is identical with the extracted rhythm pattern; a module for selectively reading out a rhythm pattern from the second rhythm pattern attendant to the group to which the detected rhythm pattern belongs; and a module for producing a length of melody which assumes contrastiveness to the melody motif based on the read-out rhythm pattern by the module for reading. Using thus arranged program, the computer creates a melody which assumes a good contrast to the supplied melody.

According to the present invention, the object is still further accomplished by providing a storage medium storing a program that is executable by a computer, which program contains: a module for supplying a rhythm pattern piece; a module for storing plural groups of rhythm patterns in which each one group contains a plurality of rhythm patterns which are similar to each other; a module for detecting, among the plural groups of rhythm patterns, a rhythm pattern which is identical with the supplied rhythm pattern; a module for selectively reading out any other rhythm pattern than the detected rhythm pattern from the rhythm pattern group to which the detected rhythm pattern belongs; and a module for producing a length of rhythm pattern which assumes similarity to the supplied rhythm pattern based on the read-out rhythm pattern by the module for reading. Using thus arranged program, the computer creates a rhythm pattern which assumes a good similarity to the supplied rhythm pattern.

According to a still further aspect of the present invention, a storage medium stores a program that is executable by a computer and contains: a module for supplying a rhythm pattern piece; a module for storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns; a module for detecting, among the first plural groups of rhythm patterns, a rhythm pattern which is identical with the supplied pattern; a module for selectively reading out a rhythm pattern from the second rhythm pattern attendant to the group to which the detected rhythm pattern belongs; and a module for producing a length of rhythm pattern which assumes contrastiveness to the supplied rhythm pattern based on the read-out rhythm pattern from the reading device. Using thus arranged program, the computer creates a melody which assumes a good contrast to the supplied melody.

As will be apparent from the description herein later, some of the structural element devices of the present invention are configured by a computer system performing the assigned functions according to the associated programs. They may of course be hardware structured discrete devices performing the same functions.

The present invention may take form in various components and arrangement of components and in various steps and arrangement of steps. The drawings are only for purposes of illustrating a preferred embodiment and processes and are not to be construed as limiting the invention.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram showing an example of an electronic musical instrument embodying a melody and rhythm creating apparatus according to the present invention;

FIGS. 7*a*, 7*b*, 7*c*, 7*d*, 7*e* and 7*f* are staves and a note name description explaining the processing steps in creating a similar melody; and FIGS. 7*g*, 7*h* and 7*i* are staves explaining the processing steps in creating a contrastive melody.

DESCRIPTION OF THE PREFERRED EMBODIMENTS

Figure 2:
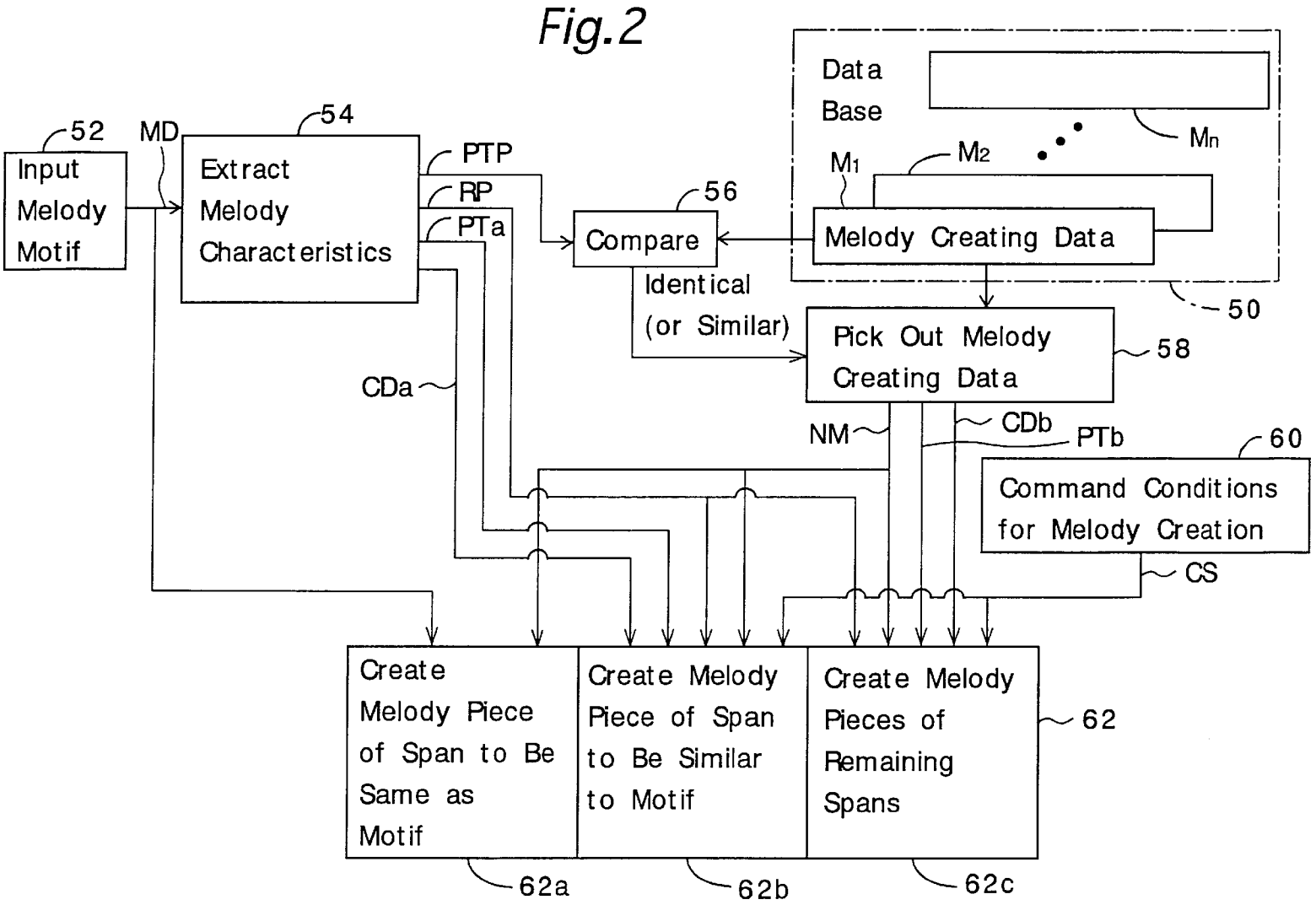
FIG. 2 is an operational block diagram showing the overview of an example of the melody and rhythm creating processing according to the present invention.

FIG. 1 is a block diagram showing a circuital structure of an example of an electronic musical instrument equipped with an embodiment of a melody and rhythm pattern creating apparatus according to the present invention. The electronic musical instrument is constructed using a small size computer such as a personal computer which controls and performs musical tone generation processing and melody and rhythm pattern creation processing according to the program.

In this computer associated system, connected to a bus 10 are a CPU (central processing unit) 12, a ROM (read only memory) 14, a RAM (random access memory) 16, a key detecting circuit 18, a switch detecting circuit 20, a display circuit 22, a tone generator circuit 24, an effects circuit 26, an external storage device 28, a MIDI interface 30, a communication interface 32 and a timer 34. The CPU 12 is to execute various processing for melody and rhythm pattern creation according to the programs stored in the ROM 14, which processing will be described hereinafter with reference to FIGS. 2–7*i*. The RAM 16 includes various storage subdivisions to be used for the respective processes by the CPU 12. Such subdivisions are a memory area 16A for storing memory motifs (motif melody pieces), a memory area 16B for storing melody characteristics, a memory area 16C for storing melody creating data, a memory area 16D for storing melody creating conditions, and a memory area 16E for storing melody data of a created melody.

The key detecting circuit 18 detects actuations of the keys in the keyboard 36 such as a musical keyboard. The switch detecting circuit 20 detects actuations of the switches 38 arranged, for example in an operation panel. Switches 38 contain, for example, key switches in an alphanumeric keyboard for inputting alphabetic characters and numeric characters, and also contain a mouse device for various commanding operations. The display circuit 22 controls displaying operations of the display device 40 to permit various visual indications on the video screen.

The tone generator circuit 24 contains a plurality of musical tone generating channels for generating various demanded tones. The type or fashion of tone generation may be a wave memory type, an FM synthesis type, a physical model type, a harmonics synthesis type, a formant synthesis type, an analog synthesizer type having VCOs, VCFs and VCAs, or any other type available in the art. The tone generator circuit 24 is not limited to a hardware structure exclusively functioning as a tone generator, but may be a combination of a DSP (digital signal processor) and a microprogram or a combination of a CPU and a software thereby functioning as a tone generator. The plural tone generating channels may be formed by plural separate (individual) hardware circuits or by a small number of hardware circuit or circuits under a time division multiplexed use. The effects circuit 26 is to impart sound effects such a chorus effect and a reverberation effect to the tone signals from the tone generator circuit 24. The effect-imparted tone signals from the effects circuit 26 are supplied to a sound system 42 to be converted into audible sounds in the atmosphere.

Figure 3:
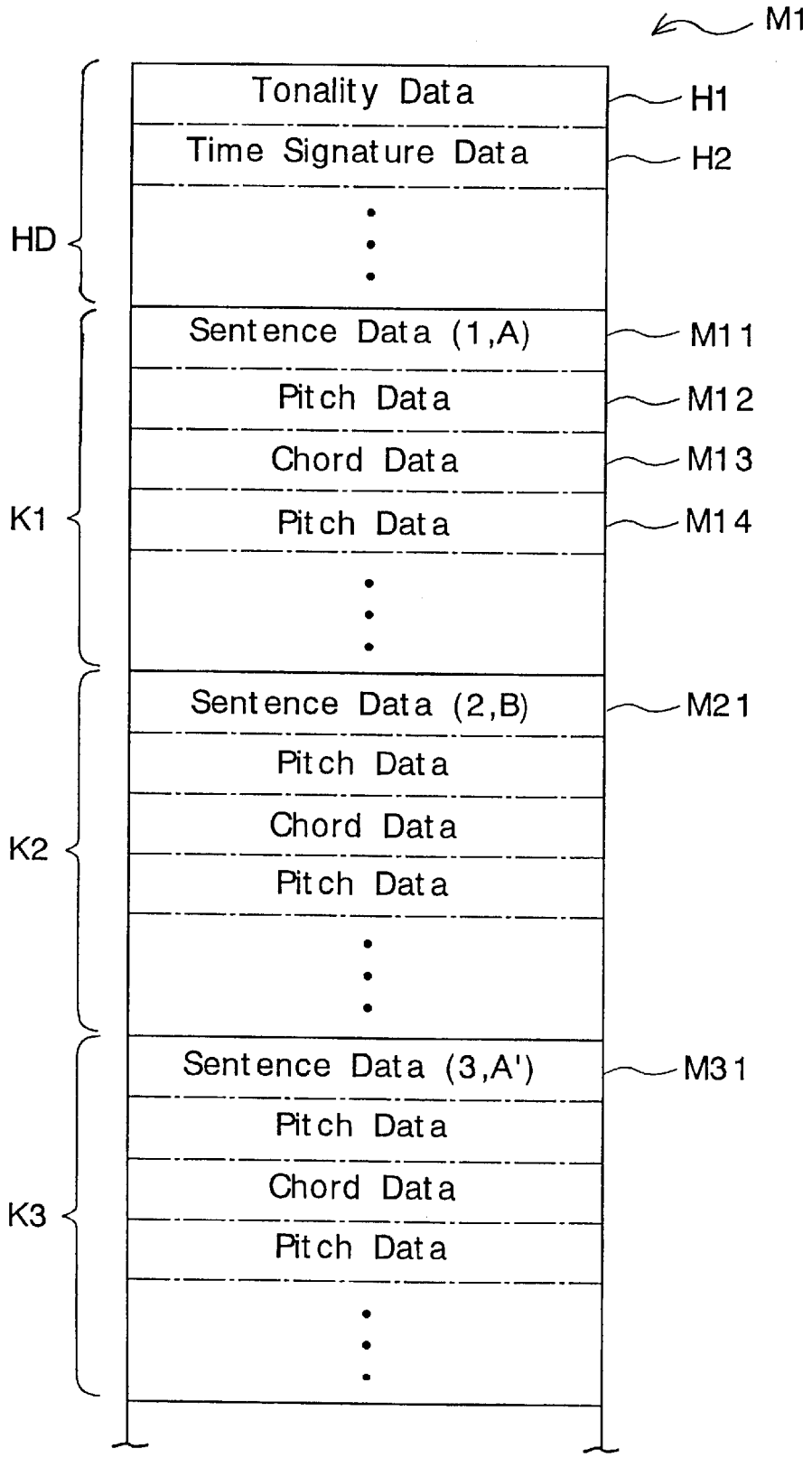
FIG. 3 is a chart showing an example of the format of the melody creating data used in the present invention.

The external storage device 28 may be detachably provided with one or plural types of storage media such as a hard disk (HD), a floppy disk (FD), a compact disk (CD), a digital versatile disk (DVD) and a magneto-optical disk (MO). When the external storage device 28 is equipped with such a storage medium, the data on the medium can be transferred to the RAM 16. Where the equipped storage medium is of a writable type like an HD and an FD, the data in the RAM 16 can be transferred to such a storage medium. A storage medium to be equipped to the external storage device carries a data base 50 including melody creating data sets M1, M2, . . . Mn respectively corresponding to a number of melodies or tunes, for example, as shown in FIG. 2. Each of the melody creating data sets is to be used for creating a melody corresponding thereto. A typical example of the data format for the melody creating data set M1 is shown in FIG. 3. The other melody creating data sets M2-Mn have a similar format as the melody creating data set M1.

The melody creating data set M1 includes, as shown in FIG. 3, a header data block HD, and span data blocks K1, K2, K3, and so forth. Each of the spans K1, K2, K3, etc. corresponds to each one musical sentence, and one sentence consists of four measures in this embodiment. The header data block HD includes tonality data H1 representing the tonality key (e.g. C major) of a tune, time signature data H2 representing the time signature (e.g. 4/4), etc. Each of the span data blocks K1, etc. includes sentence data M11 (M21, M31, . . . ), pitch data M12, M14, etc. corresponding to a plurality of skeleton notes previously determined to be primary notes or important notes in the melody span (e.g. the head note, the tail note, and the strong beat notes), chord data M13, etc. corresponding to a predetermined chord progression (sequence), and so forth. Each of the sentence data block represents the sentence number and the sentence symbol. For example, the sentence data block M11 indicates the sentence number "1" and the sentence symbol "A", the sentence data block M21 indicates the sentence number "2" and the sentence symbol "B", and the sentence data block M31 indicates the sentence number "3" and the sentence symbol "A'".

The data of the sentence symbol "A" means to create a melody piece which is identical to the inputted melody motif, the data of the sentence symbol "A'" means to create a melody piece which is similar to the inputted melody motif in terms of the rhythm pattern and the melody characteristics, and the data of the sentence symbol "B" means to create a melody piece which is different from both the sentence symbol "A" and "A'". The data to indicate the creation of a melody piece which is different from all of the sentence symbols A, A' and B assumes another symbol like "C" or "D" or else, as employed in a successive order. Using this embodiment, the melody creating processing for each of the spans having a sentence symbol B, C or D may be in any of the following manners: 1) a rhythm similar type in which a melody piece is created based on a rhythm pattern similar to the rhythm pattern of the melody motif, 2) a rhythm contrastive type in which a melody piece is created based on a rhythm pattern contrastive to the rhythm pattern of the melody motif, and 3) a rhythm random type in which a melody piece is created based on a rhythm pattern randomly selected (by the apparatus) from among the identical rhythm pattern, the similar rhythm patterns and the contrastive rhythm patterns prepared in association with the melody motif. In this connection, the sentence symbols for the respective spans (K1, etc.) in the melody creating data (M1, etc.) may include the information to indicate what type of rhythm patterns are to be used in the processing of melody creation. For example, with respect to the sentence symbol "B", three different symbols may be prepared like "B1", "B2" and "B3" so that the symbol "B1" indicates the execution of the rhythm similar type processing, that the symbol "B2" indicates the execution of the rhythm contrastive type processing and that the symbol "B3" indicates the execution of the rhythm random type processing. Similar sub-categories may be prepared for the symbols "C", "D", etc.

The data base 50 of the melody creating data may be provided in the ROM 14 or in the RAM 16 in place of the external storage device 28. The programs may be stored in the storage medium (above-mentioned HD, FD, CD, DVD, MO, etc.) of the external storage device 28 in place of the ROM 14, and may be transferred from the external storage device 28 to the RAM 16 so that the CPU 12 executes the process steps according to the program in the RAM 16. This way of the program storage and transfer will be advantageous in that additions to or upgrading of the program will be easily conducted according to the necessity.

The MIDI interface 30 is provided to transmit and receive the music performance information to and from another MIDI apparatus 44 such as an automatic performance or accompaniment apparatus. The communication interface 32 is provided to conduct data communication with a server computer 48 via a communication network 46 such as a LAN (local area network), Internet and a telephone line. Thus, the programs and the various data necessary for the implementation of the present invention can be downloaded from the server computer 48 to the RAM 16 or to the external storage device 28 via the communication network 46 and the communication interface 32 according to a download demand.

The timer 34 generates a tempo clock signal TCL having a pulse period determined by given tempo data, and supplies the tempo clock signal TCL to the CPU 12 as interrupt requests. The CPU 12 starts an interrupt operation upon receipt of each clock pulse of the tempo clock signal TCL. The apparatus thus conducts an automatic performance of the created melody based on the melody data stored in the subdivision 16E of the RAM 16.

Every time a key is depressed in the keyboard 36 of the above-mentioned electronic musical instrument, the CPU 12 supplies a pitch indicating signal and a tone generation instruction signal corresponding to the depressed key to the tone generator circuit 24. The tone generator circuit 24 in turn generates a tone signal having a pitch corresponding to the depressed key in accordance with the supplied pitch indication signal and tone generation instruction signal. Thus, the apparatus is capable of producing manual performance tones.

Next, with reference to FIG. 2 will be described the outline of an example of processing for creating melody pieces and rhythm patterns as conducted in the above described example of an electronic musical instrument. A step (process block) 52 in the operational block diagram of FIG. 2 is for the user to input a desired melody motif using the musical keyboard 36 or the alphanumeric keyboard or the mouse device in the panel switch group 38. Melody data MD representing the inputted melody motif are stored in the memory area 16A for storing melody motif pieces. A melody motif to be inputted may be, for example, a melody piece in the amount of one sentence corresponding to the first span K1 of FIG. 3. A melody motif may be inputted in various manners such as a manner in which an arbitrary span (e.g. K1) of a sentence is designated and a melody piece is inputted for the designated span, a manner in which a melody piece of the amount for a phrase or phrases (e.g. for two phrases) is inputted, and a manner in which a melody piece of the amount of a measure or measures (e.g. for two measures).

Figure 4:
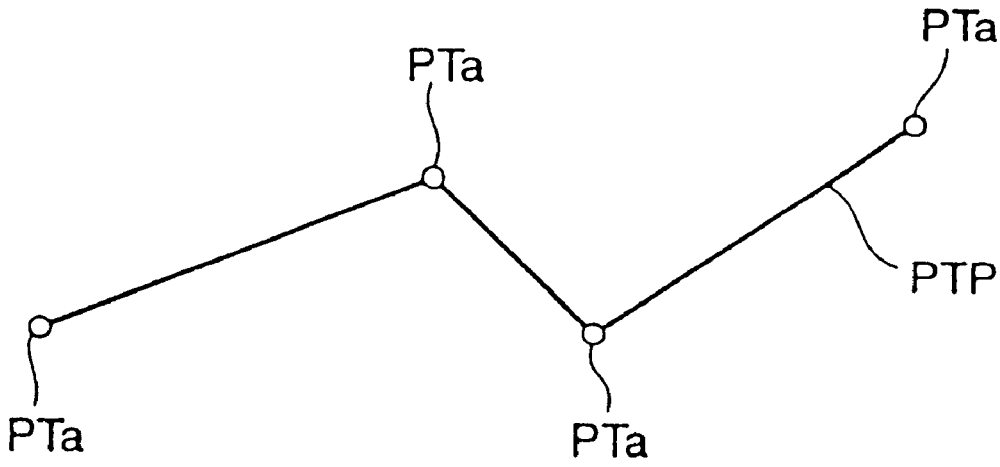
FIG. 4 is a chart showing an example of a pitch variation pattern.

A step 54 is a step which analyzes the melody data MD in the memory area 16A to extract melody characteristics of the melody data MD and detects a chord prevailing in the melody data MD. The extracted melody characteristics include a rhythm pattern (a pattern constituted by the note existing time points), the pitches of the skeleton notes or important notes having primary importance in the rhythm pattern in view of rhythm beats (e.g. the head note and the tail note of the span, and the strong beat notes in the span), the pitch variation pattern among the skeleton notes, etc. Rhythm pattern data RP representing the extracted rhythm pattern, pitch data PTa representing the pitches of the extracted skeleton notes and pitch variation pattern data PTP representing the pitch variation pattern among the extracted skeleton notes are stored in the memory area 16B for melody characteristics of FIG. 1. An example of a pitch variation pattern as represented by the data PTP is shown in FIG. 4. A chord data CDa representing the chord detected in the step 54 are used in a step 62*b* for creating a melody piece which is similar to the motif melody piece as will be described hereinafter.

A step 56 is to compare the pitch variation pattern data PTP in the memory area 16B with each of the melody creating data sets in the data base 50 to detect a melody creating data which has a pitch variation pattern identical or similar to that of the data PTP. With respect to the melody creating data sets in the data base 50, the pitch variation pattern represented by the pitch data M12, M14, etc. of the first span K1 is compared with the pitch variation pattern represented by the data PTP. Alternatively, pattern data representing the pitch variation pattern corresponding to the pitch data M12, M14, etc. may be included in the melody creating data set, and such pattern data may be used for the comparison. Further alternatively, the pitch data PTa in the memory area 16B may be compared with the pitch data M12, M14, etc.

A step 58 extracts or picks out from the data base 50 one or plural melody creating data sets whose pitch variation pattern is detected to be identical or similar to that of the melody motif. When a plurality of melody creating data sets are extracted (found in search), all of them may be displayed on the screen of the display device 40 in the musical notation format for the user to arbitrarily select any desired one. The one thus extracted or selected is stored in the memory area 16C for melody creating data in FIG. 1.

A step 60 is for the user to command desired conditions for melody creation. Among the melody conditions, the user may command a note range and so forth. Melody creating condition data CS representing the commanded melody creating conditions is stored in the memory area 16D for melody creating conditions in FIG. 1. The melody creating data may include data representing sentence symbols B1, B2, B3, etc. as described hereinbefore, or alternatively the melody creating data may include data representing a sentence symbol B and the user may command further limitation such as B1, B2 and B3 for the intended melody creating condition.

A step 62 is for generating a melody. The step 62 includes a sub-step 62*a* which creates a melody piece of the span to be identical with the melody motif, a sub-step 62*b* which creates a melody piece of the span to be similar to the melody motif, and a sub-step 62*c* which creates a melody piece of the remaining spans. In the melody creation processing, sentence data NM (this corresponds to M11, M12, M13, etc. in FIG. 3) are read out from the memory area 16C for the respective spans. Which one of the steps 62*a*, 62*b* and 62*c* is used is determined in accordance with the sentence symbol as is indicated by the sentence data NM for each of the sentence spans identified by the sentence number included in the sentence data NM.

For example, where the sentence symbol indicated by the sentence data NM is "A", a melody piece is created by the step 62*a*. In this case, when the melody motif is of a one-sentence length, the step 62*a* creates a melody piece having a length of one sentence, whereas when the melody motif is of a two-measure length, the step 62*a* creates a melody piece for a span having a length of a half sentence, as one sentence consist of four measures in this example.

Further for example, where the sentence symbol indicated by the sentence data NM is A', a melody piece is created by the step 62*b*. In this case, when the melody motif is of a one-sentence length, the step 62*b* creates a melody piece having a length of one sentence, whereas when the melody motif is of a two-measure length, the step 62*b* creates a melody piece for a span having a length of a half sentence. Where the sentence symbol is A", the melody creation is conducted in the same manner as the above described case in connection with the sentence symbol A', but the degree of resemblance or similarity is a bit different from the case of A' symbol.

Still further for example, where the sentence symbol indicated by the sentence data NM is B, C or D other than A, A', A", or where the step 62*a* or 62*b* has created a melody piece of a length of a fraction (e.g. a half) of a span, melody pieces for the remaining spans are created by the step 62*c*.

The step 62*a* creates melody data representing a melody piece which is identical with the motif melody piece by copying the motif melody data MD in the memory area 16A. For example, where the sentence data NM indicates the sentence number "1" and the sentence symbol "A" as shown by M11 in FIG. 3, the step 62*a* copies the motif melody data MD and writes in the memory area 16E as melody data for the span having a sentence number "1".

The step 62*b* creates melody data representing a melody piece which is similar to the melody motif based on the rhythm pattern data RP and the pitch data PTa being read out from the memory area 16B and on the melody creating condition data CS being read out from the memory area 16D. For example, where the sentence data NM indicate a sentence number "3" and a sentence symbol A' as shown by M31 in FIG. 3, the step 62*b* creates melody data representing a melody piece which is similar to the melody motif based on the rhythm pattern data RP and the pitch data PTa, and writes in the memory area 16E as melody data for the span having a sentence number "3". A specific example of creating a similar melody based on the rhythm pattern data RP and the pitch data PTa will be described in detail hereinafter with reference to FIGS. 7*a*–7*f*. In creating a melody piece which is similar to the melody motif based on the rhythm pattern data RP, the pitches for the melody piece may be determined by using the chord data CDa in place of the pitch data PTa. Further, the pitch variation pattern data PTP may be used in place of the pitch data PTa.

The step 62*c* creates melody data representing melody pieces for the remaining spans based on the rhythm pattern data RP being read out from the memory area 16B, the pitch data PTb (corresponding to M12, M14, etc. in FIG. 3) being read out from the memory area 16C and the melody creating condition data CS being read out from the memory area 16D. For example, where the sentence data NM indicate a sentence number "2" and a sentence symbol B as shown by M21 in FIG. 3, the step 62*c* creates melody data representing melody pieces for the remaining spans based on the rhythm pattern data RP and the pitch data PTb, and writes in the memory area 16E as melody data for the span having a sentence number "2". The melody pieces for the remaining spans may be contrastive ones to the motif melody piece where the sentence symbols are B, C or D, and may be similar ones to the motif melody piece where the step 62*a* or 62*b* has created a melody piece in an amount of a fractional portion of a span (e.g. a half span). In creating melody pieces for the remaining spans based on the rhythm pattern data RP, the pitches for the melody pieces may be determined by using the chord data (e.g. M13 in FIG. 3) in the melody creating data in place of or in addition to the pitch data PTb.

In the process of creating melody pieces for the remaining spans, melody piece are created with relation to the melody motif in terms of the rhythm pattern RP, but not in terms of the pitch characteristics (e.g. PTa). Generally speaking, in music compositions, note pitches of the spans having identical or similar sentence symbols (e.g. A and A') are highly similar to each other, but note pitches of the spans having different sentence symbols (B, C, and D) have almost no relation (similar or contrastive) with each other. On the other hand, many music compositions exhibit some relations among all sentences in terms of rhythm. Therefore, it is preferable to render some relation among all the spans in terms of rhythm.

In the above described process with reference to FIG. 2, processes of the steps 62*a*–62*c* are selectively executed in succession according to the sentence numbers and the sentence symbols as indicated by the sentence data NM, and accumulatively the melody data representing a length of a melody in the amount of one piece of music can be obtained in the memory area 16E.

A length of melody constituting one piece of music or tune thus obtained includes a melody portion which is identical with the user-inputted melody motif in rhythm pattern and in pitch characteristics, a melody portion which is similar to the user-inputted melody motif in rhythm pattern and in pitch characteristics and a melody portion which is similar to or contrastive to the user-inputted melody motif only in rhythm pattern, and therefore constitutes a melody which is suited to the given melody motif and has a high degree of musical perfection with abundant ups and downs.

The melody creating process for the remaining spans at the step 62*c* may include any of the process of creating similar (to the motif) melody pieces, the process of creating contrastive (to the motif) melody pieces and the process of creating an identical (to the motif) melody piece or a similar melody piece or a contrastive melody piece randomly. An example of such a selective process at the step block 62 will be described hereinafter making reference to FIGS. 5*a*, 5*b* and 6.

Figure 5A:
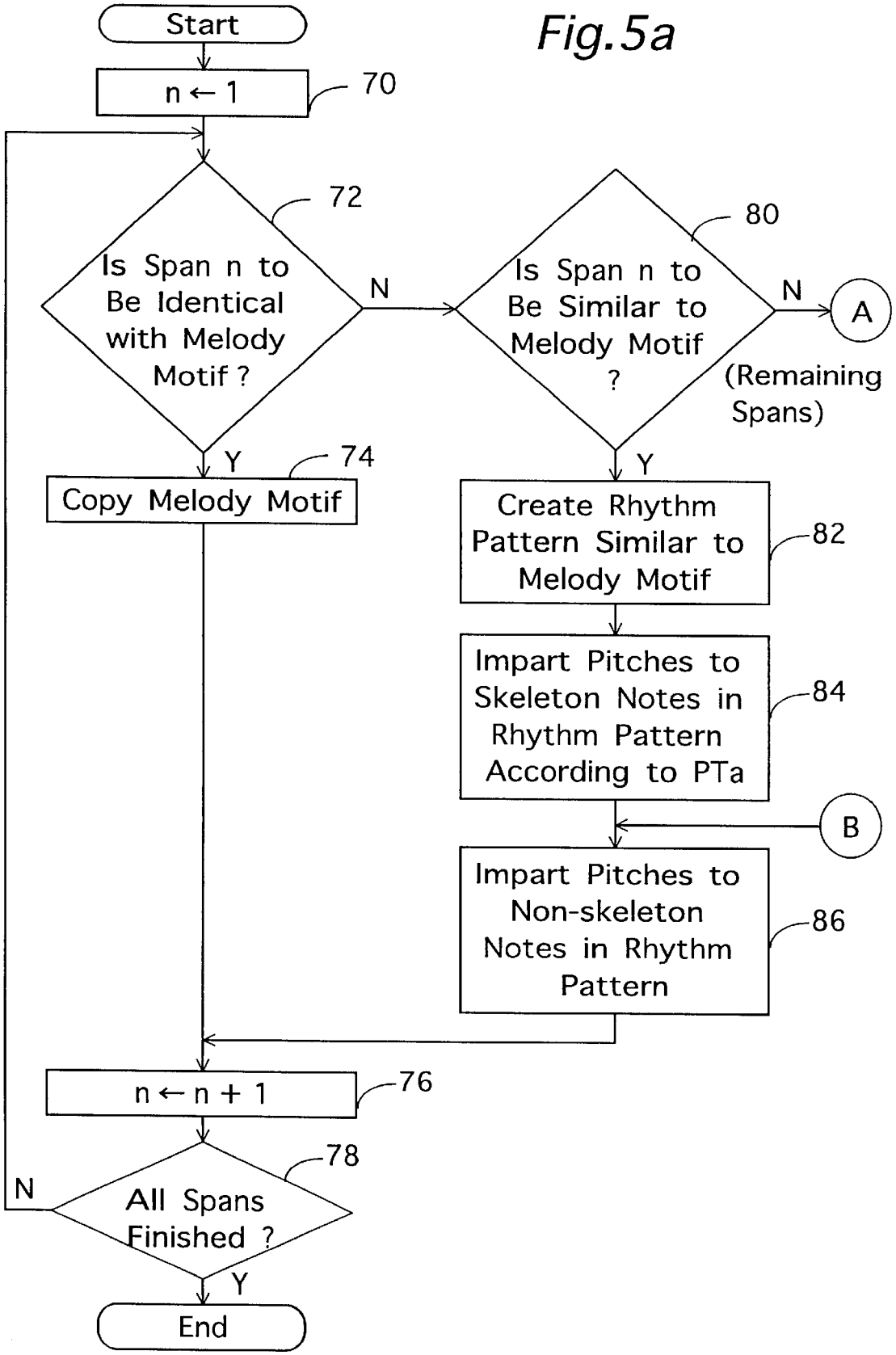
FIGS. 5*a* and 5*b* are, in combination, a flow chart showing an example of melody creating processing according to the present invention.
Figure 5B:
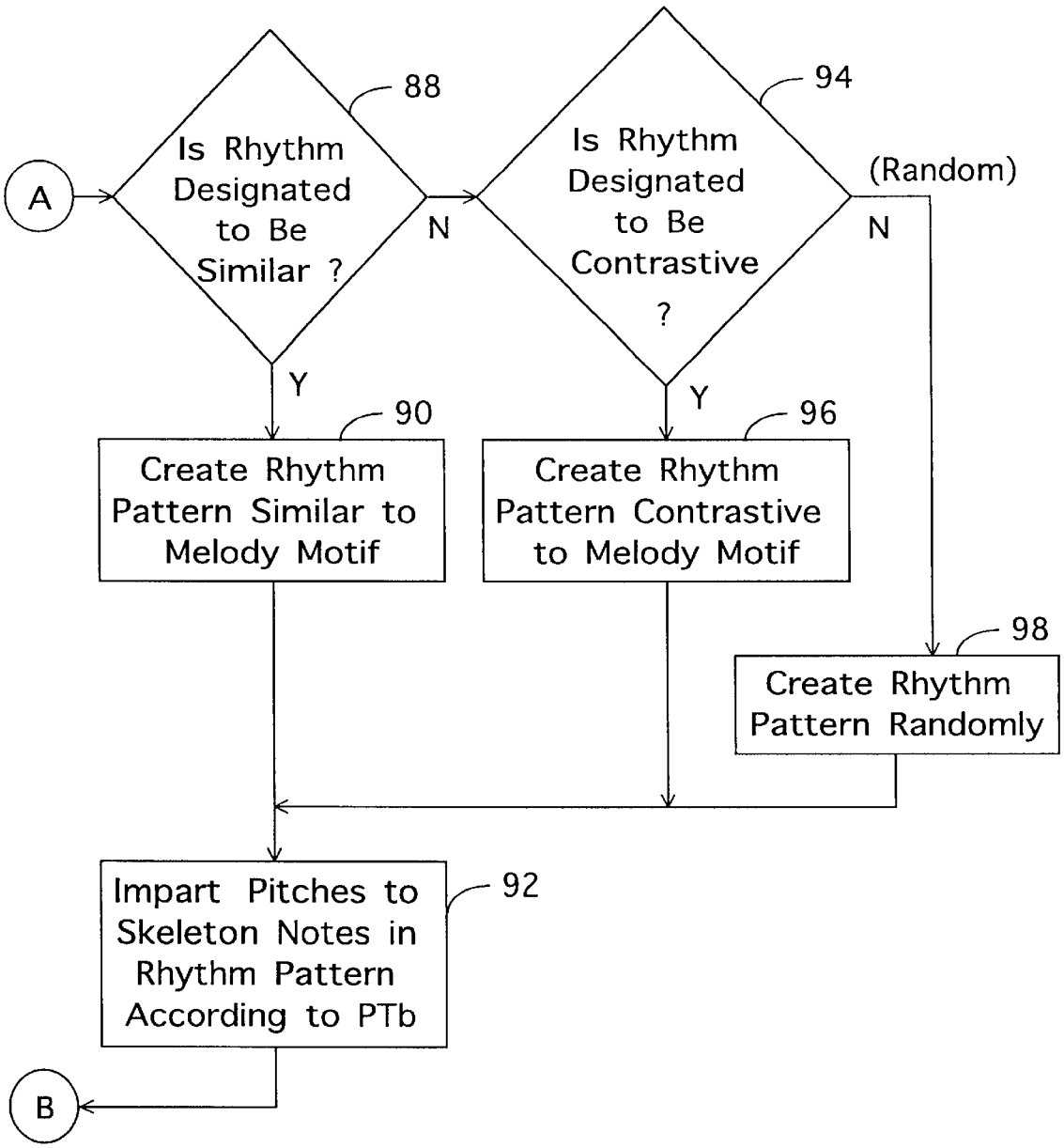

FIGS. 5*a* and 5*b* show in combination a flow chart of an example of a melody creating process to be employed for the step 62. A step 70 sets a span number "1" into a span number register n. A predetermined memory location in the RAM 16 is used for the register n. Next, a step 72 judges whether the span n (a span having the number of the register n) is a span to be identical with the melody motif like the span K1 in FIG. 3. If the judgment is affirmative (Y), the process proceeds to a step 74. The step 74 copies the melody motif MD in the memory area 16A to create melody data representing a melody piece which is identical with the motif melody piece. Thereafter the process goes forward to a step 76. The step 76 increases the value of the register n by "1". Then the process proceeds to a step 78, which judges whether the processing for all of the spans has been finished. Whether the processing for all the spans has been finished is known by checking whether the value of the register n exceeds the last span number in the melody creating data in the memory area 16C. When the step 78 judges negative (N), the process goes back to the step 72 to continue the processing for the next span.

When the step 72 judges negative (N), the process moves forward to a step 80. The step 80 judges whether the span n is a span to be similar to the melody motif like the span K3 in FIG. 3. When the process comes to the step 80 for the first time after the step 76 sets "n=2", the example of FIG. 3 (the span K2) renders the judgment of the step 80 negative (N) to direct the process to a step 88 in FIG. 5*b*. The steps 88 onward in FIG. 5*b* and a step 86 in FIG. 5*a* are the steps for the process of creating melody pieces for the remaining spans, the details of which will be described hereinafter. After the step 86, the process proceeds through the step 76 and the step 78 to go back to the step 72. When the process comes to the step 72 for the first time after the step 76 sets "n=3", the example of FIG. 3 renders the judgment of the step 72 negative (N) to direct the process to the step 80. The step 80 in this instance judges affirmative (Y) and the process moves forward to a step 82.

The step 82 creates a rhythm pattern which is similar to the rhythm pattern of the motif melody piece. A method for creating a similar rhythm pattern may be a) a method as will be described hereinafter with reference to FIG. 6, b) a method in which the motif rhythm pattern extracted from the melody motif is modified by some mathematical operation or computation, and so forth. In the modifying method of b) above, one or more note time points may be deleted from and/or added to the motif rhythm pattern randomly. After the step 82 comes a step 84. The step 84 imparts pitches to a plurality of previously determined skeleton notes (primary or important notes) in the similar rhythm pattern as created at the step 82 in accordance with the pitch data PTa. And the process moves forward to the step 86. The step 86 imparts pitches to non-skeleton notes (notes other than primary or important notes) in the similar rhythm pattern as created at the step 82 by determining pitches using passing notes (in a conjunct motion, i.e. motion by an interval of the second), unison notes, appoggiatura (in a conjunct motion to the succeeding note), etc. The chord data CDa may be used in this pitch determination.

A manner of creating a similar melody piece in an example of the process flow through the steps 82–86 is now explained with reference to FIGS. 7*a*–7*f*. FIG. 7*a* shows a melody motif inputted by the user at the step 52 in FIG. 2. FIG. 7*b* shows the strong beat notes C, E, D and F extracted as skeleton notes from the melody motif at the step 54 in FIG. 2. FIG. 7*c* shows a motif rhythm pattern extracted from the melody motif at the step 54 of FIG. 2. The step 82 creates a similar rhythm pattern as shown in FIG. 7*d* based on the motif rhythm pattern of FIG. 7*c*. The step 84 imparts pitches of the strong beat notes C, E, D and F of FIG. 7*b* to four skeleton notes (strong beat points in the rhythm pattern) in the similar rhythm pattern, respectively, as shown in FIG. 7*e*. The step 86 imparts pitches to the non-skeleton notes in the similar rhythm pattern by determining pitches using musical theory of a passing note (a), a unison note (b), appoggiatura (c), etc., respectively, as shown in FIG. 7*f*. In case there is no note at the time point of a strong beat during the process of extracting a strong beat note to be a skeleton note, an immediately preceding note to the strong beat point is extracted as a skeleton note. Such an immediately preceding note is to be imparted with a pitch for a skeleton note at the step 84.

According to the above described method of creating a similar melody piece, the strong beat notes (or in case there is no note at the strong beat time position, the note immediately preceding the strong beat time position) in a rhythm pattern which is similar to the motif rhythm pattern are given the corresponding pitches of the corresponding beat notes in the melody motif, respectively, and therefore the obtained melody piece assumes good similarity with the given melody motif.

After the step 86, the process proceeds through the step 76 and the step 78 to go back to the step 72 to repeat the process from the step 72 onward as explained above for the next span n.

When the step 80 judges that the subject span n is not a similar span (i.e. a span to be similar to the melody motif), that is "negative (N)" like in the case of the span K2 in FIG. 3, the span n is a remaining span (a span which is neither an identical span nor an similar span), and the process proceeds to the step 88. The step 88 judges whether the rhythm pattern to be created is designated to be similar to the motif rhythm pattern. This judgment is conducted based on the sentence data NM or the melody creating condition data CS to judge whether the designated melody creating process is the rhythm similar type (e.g. the sentence symbol is B1) or not. If the judgment at the step 88 is affirmative (Y), the process moves forward to a step 90. The step 90 creates a rhythm pattern piece which is similar to the rhythm pattern of the melody motif as in the step 82. Next, the step 92 imparts pitches to the skeleton notes in the similar rhythm pattern created at the step 90 according to the pitch data PTb, respectively. In the example shown in FIG. 3, the pitch data M12, M14, etc. are used for imparting pitches to the skeleton notes in the similar rhythm pattern. The process, then, moves to the step 86. The step 86 imparts pitches to the non-skeleton notes in a manner as explained above. Then, the process proceeds through the step 76 and the step 78 before going back to the step 72.

When the step 88 judges negative (N), a step 94 judges whether the rhythm pattern to be created is designated to be contrastive to the motif rhythm pattern. This judgment is conducted based on the sentence data NM or the melody creating condition data CS to judge whether the designated melody creating process is the rhythm contrastive type (e.g. the sentence symbol is B2) or not. If the judgment at the step 94 is affirmative (Y), the process moves forward to a step 96. The step 96 creates a rhythm pattern piece which is contrastive to the rhythm pattern of the melody motif. A method for creating a contrastive rhythm pattern may be a method a) or a method b) as described with respect to the step 82. After the step 96, the process moves forward to the step 92. The step 92 imparts pitches to the skeleton notes in the rhythm pattern and the step 86 imparts pitches to the non-skeleton notes in the rhythm pattern in a similar manner described above. Thereafter, the process goes through the step 76 and the step 78 back to the step 72.

A manner of creating a contrastive melody piece in an example of the process flow through the steps 96, 92 and 86 is now explained with reference to FIGS. 7*a*–7*c* and 7*g*–7*i*. FIG. 7*a* shows a melody motif inputted by the user at the step 52 in FIG. 2. FIG. 7*b* shows the strong beat notes C, E, D and F extracted as skeleton notes from the melody motif at the step 54 in FIG. 2. FIG. 7*c* shows a motif rhythm pattern extracted from the melody motif at the step 54 of FIG. 2. The step 96 creates a contrastive rhythm pattern as shown in FIG. 7*g* with reference to the motif rhythm pattern of FIG. 7*c*. The step 92 imparts pitches of the strong beat notes C, E, D and F of FIG. 7*b* to four skeleton notes (strong beat points in the rhythm pattern) in the contrastive rhythm pattern, respectively, as shown in FIG. 7*h*. The step 86 imparts pitches to the non-skeleton notes in the contrastive rhythm pattern by determining pitches using musical theory of a passing note, a unison note, appoggiatura, etc., respectively, as shown in FIG. 7*i*. In case there is no note at the time point of a strong beat during the process of extracting a strong beat note to be a skeleton note, an immediately preceding note to the strong beat point is extracted as a skeleton note. Such an immediately preceding note is to be imparted with a pitch for a skeleton note at the step 92.

Where the step 94 judges negative (N), it means that the sentence data NM or the melody creating condition data CS designates the random type melody creating process (e.g. the sentence symbol is B3), and the process moves to a step 98. The step 98 creates a rhythm pattern piece by randomly selecting from among the identical rhythm pattern, the similar rhythm patterns and the contrastive rhythm patterns prepared in association with the melody motif. This processing may be conducted by the processing to be described hereinafter with reference to FIG. 6. After the step 98 comes the step 92. The step 92 imparts pitches to the skeleton notes in the rhythm pattern and the step 86 imparts pitches to the non-skeleton notes in the rhythm pattern in a similar manner described above. Thereafter, the process goes through the step 76 and the step 78 back to the step 72.

By repeating the melody creating processing for each of the spans as described above a number of times until the melody piece for the last span has been created, the step 78 judges affirmative (Y) and the processing comes to its end (FIG. 5*a*).

In the processing by the example described above with reference to FIGS. 5*a* and 5*b*, the step 98 creates an identical rhythm pattern with that of the melody motif. The step 90 may also create a rhythm pattern identical with that of the melody motif. Further, a span may not necessarily limited to the length of a musical sentence, but may be the length of a musical block, a musical phrase, a musical measure, or else. According to the processing through the steps 90, 92 and 86, the skeleton notes in the rhythm pattern piece which is similar to (or identical with) that of the melody motif are given pitches in accordance with the pitch data PTb, and therefore a melody which assumes a good similarity to the melody motif can be obtained. According to the processing through the steps 96, 92 and 86, the skeleton notes in the rhythm pattern piece which is contrastive to that of the melody motif are given pitches in accordance with the pitch data PTb, and therefore a melody which assumes a good contrast to the melody motif can be obtained.

Figure 6:
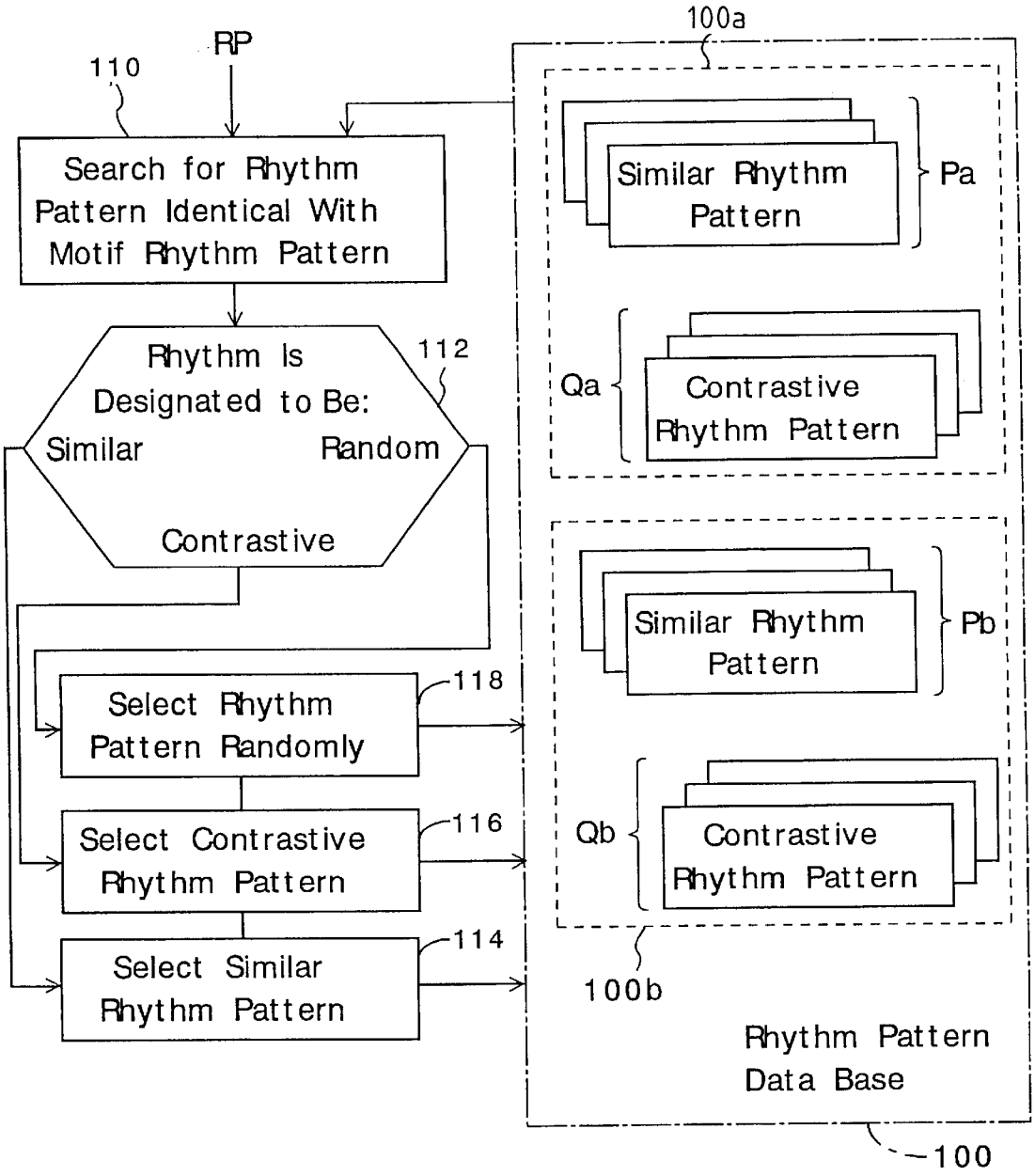
FIG. 6 is a flow chart showing an example of rhythm pattern creating processing according to the present invention.

FIG. 6 shows a flow chart of an example of rhythm pattern creating processing to be employed in the processing of FIGS. 5*a* and 5*b*. The rhythm pattern data base 100 includes a plurality of storage areas 100*a*, 10*b*, etc. The storage area 100*a* stores a plurality of rhythm patterns which belong to a first pattern group Pa and a plurality of rhythm patterns which belong to a second pattern group Qa attendant to the first pattern group Pa. The rhythm patterns which belong to the pattern group Pa are similar rhythm patterns which are similar patterns to each other, for example, by satisfying conditions that there exist a certain number of syncopated notes and dotted notes and that the dense/sparse distribution of notes is same or similar, and assuming a certain musical atmosphere in common. The rhythm patterns which belong to the pattern group Qa are contrastive rhythm patterns which are respectively contrastive to the respective rhythm patterns in the pattern group Pa.

The storage area 100*b* stores a plurality of rhythm patterns which belong to a first pattern group Pb and a plurality of rhythm patterns which belong to a second pattern group Qb attendant to the first pattern group Pb. The rhythm patterns which belong to the pattern group Pb are similar rhythm patterns which are similar patterns to each other by assuming a certain common musical atmosphere in view of a different conditions than the case of the rhythm patterns in the pattern group Pa explained in the preceding paragraph. The rhythm patterns which belong to the pattern group Qb are contrastive rhythm patterns which are respectively contrastive to the respective rhythm patterns in the pattern group Pb.

There are other storage areas, although not specifically shown in FIG. 6, than the storage areas 100*a* and 100*b* above, and each area stores similar rhythm patterns of its first pattern group and contrastive rhythm patterns of its second pattern group attendant to its first pattern group. As one particular rhythm pattern may satisfy several grouping conditions, such a particular rhythm pattern can belong to a plurality of pattern groups. The data base 100 may be provided in an external storage device 28, ROM 14, RAM 16, and so forth.

The creation of a rhythm pattern piece is conducted by selectively reading out from the data base 100 some rhythm pattern. A step 110 compares the motif rhythm pattern represented by the rhythm pattern data RP delivered from the step 54 in FIG. 2 with each of the rhythm patterns in the pattern groups Pa, Pb, etc. to search for a rhythm pattern which is identical with the motif rhythm pattern.

The next step 112 judges whether the rhythm designation is "similar", or "contrastive", or "random". In this instance, "similar" means the processing of the rhythm-similar type melody creation (e.g. designation by, for example, a sentence symbol B1), "contrastive" means the processing of the rhythm-contrastive type melody creation (e.g. designation by, for example, a sentence symbol B2), and "random" means the processing of the rhythm-random type melody creation (e.g. designation by, for example, a sentence symbol B3).

When the step 112 judges that the rhythm designation is "similar", the process proceeds to a step 114 to select, from a pattern group (e.g. Pa) to which the rhythm pattern extracted by the step 110 (i.e. the rhythm pattern which is identical with the motif rhythm pattern) belongs, some similar rhythm pattern other than the rhythm pattern extracted by the step 110.

When the step 112 judges that the rhythm designation is "contrastive", the process proceeds to a step 116 to select, from a pattern group (e.g. Qa) which is attendant to the pattern group (e.g. Pa) to which the rhythm pattern extracted by the step 110 belongs, some contrastive rhythm pattern.

When the step 112 judges that the rhythm designation is "random", the process proceeds to a step 118 to select, from both the pattern group (e.g. Pa) to which the rhythm pattern extracted by the step 110 belongs and the pattern group (e.g. Qa) which is attendant to the former pattern group (e.g. Pa), any rhythm pattern randomly, and reads out the selected rhythm pattern. In this instance, the read out rhythm pattern may be a rhythm pattern which is identical with the motif rhythm pattern, or may be a rhythm pattern which is similar to the motif rhythm pattern, or may be a rhythm pattern which is contrastive to the motif rhythm pattern.

In the processing of FIG. 6, the order of priority may preferably be determined beforehand among the pattern groups Pa, Pb, etc. If so determined, the step 114 or 116 or 118 can select the pattern group having the highest priority, when the rhythm patterns (the one which is identical with the motif rhythm pattern) are searched for by the step 110 through a plurality of pattern groups.

Within the storage areas in the data base 100, the first and the second pattern groups may be provided with respect to the number of notes included in the rhythm patterns. Under such a situation, "the number of notes to be created" will be designated. A rhythm pattern will be selected from among the similar rhythm patterns or the contrastive rhythm patterns having the number of notes as commanded at the step 60 in FIG. 2 out of the pattern groups which includes the rhythm pattern extracted by the step 110. According to such a structure, a melody which has a good similarity or contrast to the motif melody can be created under the control of the number of notes to be included in the melody piece to be created. This will be suitable for the creation of a melody which matches the previously provided lyrics or words in terms of syllable number.

By using the process of the steps 110 and 114, the step 82 (FIG. 5*a*) or the step 90 (FIG. 5*b*) can create a melody which is similar to the motif melody. By using the process of the steps 110 and 116, the step 96 (FIG. 5*b*) can create a melody which is contrastive to the motif melody. By using the process of the steps 110 and 118, the step 98 (FIG. 5*b*) can create a melody which is either similar or contrastive to the motif melody.

According to the processing of FIG. 6, any of the rhythm patterns which are respectively identical with, similar to and contrastive to the melody motif can be created, and any of such rhythm patterns can be produced randomly, which is suitable for obtaining a melody abundant in variation (a kind of colorful melody). As the rhythm patterns are selectively read out by using the extraction of the rhythm pattern which is identical with the motif rhythm pattern, the construction of the apparatus and the execution of the processing will be simpler than the case where the rhythm patterns are selectively read out by comparing the degree of similarity or contrast with the motif rhythm pattern.

Although some specific examples of the present invention have been described above, this invention may not be limited to those examples but may be variously modified to perform the contemplated functions without departing from the spirit of the present invention. Examples of such a modification will be as follows.

(1) In order for the user to supply desired melody data, the invention may be so practiced that the user can input melody data by actually playing an electronic or an electric musical instrument such as of a keyboard type, a stringed instrument type (e.g. a guitar type), a wind instrument type, etc. in real time, or that the user can input melody data by actuating note pitch designating switches and note duration designating switches one note after another. A further alternative may be that the user inputs time points for the notes to constitute a melody, for example, by tapping a particular switch in the rhythm of an intended melody to constitute a series of note time points, displaying the inputted time points on a display screen with the horizontal direction taken as the time axis, and dragging each of the displayed time points in the vertical direction taken as the pitch direction using a pointing device such as a mouse to set a pitch therefor. Still further, a melody may be inputted by storing melody data of a plurality of melodies in the external storage device 28 or the ROM 14 or else, and the melodies may be audibly emitted or the melodies may be visually displayed in musical notation on the screen of the display device 40 so that the user can select a desired one from among such presented melodies. Still further, melody data of a melody composed by an automatic music composing apparatus employing the present invention or some other type of automatic music composing apparatus.

(2) Where a melody is created based on a rhythm pattern read out from the rhythm pattern data base 100, the melody may be created making reference to chord data in the melody creating data as shown in FIG. 2. An apparatus may employ a structure with which the user can input a desired chord progression (chord sequence) through the keyboard 36 or the switches 38 or a structure with which the user can selectively designate a desired chord progression on the screen of the display device 40 so that a melody which fits the inputted or designated chord progression can be created.

(3) The format of the music data (including melody data and chord data) may not necessarily be limited to an "event+relative time" type in which each event is represented by the event identification and the relative time measured from the immediately preceding event, but may be an "event+absolute time" type in which each event is expressed by the event identification and the absolute time measured from the beginning of the tune or each measure, may be a "pitch (rest)+duration" type in which the music progression is expressed by the pitch and the duration of each note and the duration of each rest, an "event mapping" type in which memory locations are secured and allotted for all of a plurality of minimum time units and all the events are written at the respectively corresponding time positions in the memory location, and may be any other arbitrary type.

(4) The present invention may not necessarily be implemented in the form of an electronic musical instrument, but can be realized in the form of a combination of a personal computer and an application software. The application software may be supplied to the personal computer from any suitable storage media such as a magnetic disk, a magneto-optical disk and a semiconductor memory, or may be supplied to the personal computer via a communication network.

(5) The present invention may be also applied for composing music accompaniment pieces in use for a karaoke apparatus (musical accompaniment apparatuses for singing songs), and may not be limited to electronic musical instruments.

(6) The present invention may not necessarily be limited to an electronic musical instrument of a keyboard type, but may also be applicable to an electronic musical instrument of a stringed instrument type, a wind instrument type, a percussion instrument type, etc.

(7) The present invention is applicable not only to an electronic musical instrument with a built-in tone generator device, a built-in automatic performance device, etc., but to a combined musical system including a separate keyboard, a separate tone generator, a separate automatic performance device interconnected via a MIDI network or other various communication networks.

According to the present invention, pitch characteristics and a rhythm pattern is extracted from a desired melody piece, and a melody is created based on the extracted rhythm pattern or a rhythm pattern which is similar to the extracted rhythm pattern and on the extracted pitch characteristics. And therefore, a melody which has a good similarity to the given desired melody can be obtained.

Further, as a rhythm pattern is extracted from a desired melody piece, and a melody is created based on a rhythm pattern which is contrastive to the extracted rhythm pattern and on information of pitches to be imparted to skeleton notes in the rhythm pattern, there will be obtained a melody which assumes a good contrastiveness to the given desired melody.

Further, as a rhythm pattern is extracted from a desired melody piece, and a rhythm pattern which shows a good similarity to the extracted rhythm pattern is selected from among plural groups of similar rhythm patterns stored in the storage device, there will be obtained a melody which shows a good similarity to the given desired melody.

Further, as a rhythm pattern is extracted from a desired melody piece, and a rhythm pattern which has a good contrastiveness to the extracted rhythm pattern is selected from among plural groups of contrastive rhythm patterns stored in the storage device, there will be obtained a melody which has a good contrastiveness to the given desired melody.

Further, as plural groups of rhythm patterns are stored in the storage device in which each one group contains a plurality of rhythm patterns which are similar to each other, and a rhythm pattern which is identical with a given desired rhythm pattern is detected and any other rhythm pattern than the detected rhythm pattern is selectively read out from the rhythm pattern group to which the detected rhythm pattern belongs, there will be easily obtained a rhythm pattern which assumes a good similarity to the given desired rhythm pattern.

Further, as the storage device stores plural groups of rhythm patterns in which each one group contains a first plurality of rhythm patterns which are similar to each other and, attendant to the first plurality of rhythm patterns, a second plurality of rhythm patterns which are contrastive to the first plurality of rhythm patterns, and a rhythm pattern which is identical with the given desired rhythm pattern is detected, and a rhythm pattern which is identical with the given desired rhythm pattern is detected and a rhythm pattern is read out from the second rhythm patterns attendant to the group to which the detected rhythm pattern belongs, there will be easily obtained a rhythm pattern which assumes a good contrastiveness to the given desired rhythm patterns.

As will be apparent from the description hereinabove, some of the structural element devices of the present invention are configured by a computer system performing the assigned functions according to the associated programs. They may of course be hardware structured discrete devices. Therefore, a hardware-structured device performing a certain function and a computer-configured device performing the same function should be considered a same-named device or at least an equivalent to each other.

While particular embodiments of the invention have been described, it will, of course, be understood by those skilled in the art without departing from the spirit that the invention is not limited thereto since modifications may be made by those skilled in the art, particularly in light of the foregoing teachings. It will be understood that the embodiments shown in the drawings and described above are merely for illustrative purposes, and are not intended to limit the scope of the invention. It is therefore contemplated by the appended claims to cover any such modifications that incorporate those features of these improvements in the true spirit and scope of the invention.

What is claimed is:

1. A musical apparatus for creating a melody by extracting characteristic features of a given melody motif, the apparatus comprising:

a melody motif supplier which supplies a motif melody piece;

a melody analyzer which analyzes said supplied motif melody piece to extract pitch characteristics and a rhythm pattern of said supplied motif melody piece, said extracted rhythm pattern consisting of a series of rhythmic alignment of note time points including skeleton note time points having primary importance in view of rhythm beats and non-skeleton note time points having secondary importance in view of rhythm beats;

a pitch imparter which imparts note pitches to said skeleton note time points in said extracted rhythm pattern, respectively, according to said extracted pitch characteristics to make pitch imparted skeleton notes, and imparts note pitches to said non-skeleton note time points in said extracted rhythm pattern, respectively, according to musical grammar making reference to the pitch imparted skeleton notes to make pitch imparted non-skeleton notes; and a melody producer which combines said pitch imparted skeleton notes and said pitch imparted non-skeleton notes to produce a length of melody.

2. A musical apparatus for creating a melody by extracting characteristic features of a given melody motif, the apparatus comprising:

a melody motif supplier which supplies a motif melody piece;

a melody analyzer which analyzes said supplied motif melody piece to extract pitch characteristics and a rhythm pattern of said supplied motif melody piece, said rhythm pattern consisting of a series of rhythmic alignment of note time points;

a similar rhythm pattern creator which creates a rhythm pattern being similar to said extracted rhythm pattern and consisting of a series of rhythmic alignment of note time points including skeleton note time points having primary importance in view of rhythm beats and non-skeleton note time points having secondary importance in view of rhythm beats;

a pitch imparter which imparts note pitches to said skeleton note time points in said similar rhythm pattern, respectively, according to said extracted pitch characteristics to make pitch imparted skeleton notes, and imparts note pitches to said non-skeleton note time points in said similar rhythm pattern, respectively, according to musical grammar making reference to the pitch imparted skeleton notes to make pitch imparted non-skeleton notes; and a melody producer which combines said pitch imparted skeleton notes and said pitch imparted non-skeleton notes to produce a length of melody.

3. A musical apparatus for creating a melody as claimed in claim 2, wherein said similar rhythm pattern creator includes:

a storer which stores plural groups of rhythm patterns in which each one group contains a plurality of rhythm patterns which are similar to each other;

a detector which detects, among said plural groups of rhythm patterns, a rhythm pattern which is identical with said extracted rhythm pattern; and a reader which selectively reads out any other rhythm pattern than the detected rhythm pattern from the rhythm pattern group to which said detected rhythm pattern belongs, the read-out rhythm pattern being employed as the created similar rhythm pattern.

4. A musical apparatus for creating a melody by making reference to a given melody motif, the apparatus comprising:

a melody motif supplier which supplies a motif melody piece;

a melody analyzer which analyzes said supplied motif melody piece to extract a rhythm pattern of said supplied motif melody piece, said rhythm pattern consisting of a series of rhythmic alignment of note time points;

a contrastive rhythm pattern creator which creates a rhythm pattern being contrastive to said extracted rhythm pattern and consisting of a series of rhythmic alignment of note time points including skeleton note time points having primary importance in view of rhythm beats and non-skeleton note time points having secondary importance in view of rhythm beats;

a pitch provider which provides pitch information deciding pitches to be imparted to said skeleton notes;

a pitch imparter which imparts note pitches to said skeleton note time points in said contrastive rhythm pattern, respectively, according to said provided pitch information to make pitch imparted skeleton notes, and imparts note pitches to said non-skeleton note time points in said contrastive rhythm pattern, respectively, according to musical grammar making reference to the pitch imparted skeleton notes to make pitch imparted non-skeleton notes; and a melody producer which combines said pitch imparted skeleton notes and said pitch imparted non-skeleton notes to produce a length of melody.

5. A musical apparatus for creating a melody as claimed in claim 4, wherein said contrastive rhythm pattern creator includes:

a storer which stores plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a detector which detects, among said first plural groups of rhythm patterns, a rhythm pattern which is identical with said extracted rhythm pattern; and a reader which selectively reads out a rhythm pattern from said second rhythm pattern attendant to the group to which the detected rhythm pattern belongs, the read-out rhythm pattern being employed as the created contrastive rhythm pattern.

6. A musical apparatus for creating a melody by making reference to a given melody motif, the apparatus comprising:

a melody motif supplier which supplies a motif melody piece;

a melody analyzer which analyzes said supplied motif melody piece to extract a rhythm pattern of said supplied motif melody piece;

a storer which stores plural groups of rhythm patterns in which each one group contains a plurality of rhythm patterns which are similar to each other;

a detector which detects, among said plural groups of rhythm patterns, a rhythm pattern which is identical with said extracted rhythm pattern;

a reader which selectively reads out any other rhythm pattern than the detected rhythm pattern from the rhythm pattern group to which said detected rhythm pattern belongs; and a melody producer which produces a length of melody which assumes similarity to the melody motif based on said read-out rhythm pattern from said reader.

7. A musical apparatus for creating a melody by making reference to a given melody motif, the apparatus comprising:

a melody motif supplier which supplies a motif melody piece;

a melody analyzer which analyzes said supplied motif melody piece to extract a rhythm pattern of said supplied motif melody piece;

a storer which stores plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a detector which detects, among said first plural groups of rhythm patterns, a rhythm pattern which is identical with said extracted rhythm pattern;

a reader which selectively reads out a rhythm pattern from said second rhythm pattern attendant to the group to which said detected rhythm pattern belongs; and a melody producer which produces a length of melody which assumes contrastiveness to the melody motif based on said read-out rhythm pattern from said reader.

8. A musical apparatus for creating a rhythm pattern by making reference to a given rhythm pattern, the apparatus comprising:

a rhythm pattern supplier which supplies a rhythm pattern piece;

a storer which stores plural groups of rhythm patterns in which each one group contains a plurality of rhythm patterns which are similar to each other;

a detector which detects, among said plural groups of rhythm patterns, a rhythm pattern which is identical with said supplied rhythm pattern;

a reader which selectively reads out any other rhythm pattern than the detected rhythm pattern from the rhythm pattern group to which said detected rhythm pattern belongs; and a rhythm pattern producer which produces a length of rhythm pattern which assumes similarity to the supplied rhythm pattern based on said read-out rhythm pattern from said reader.

9. A musical apparatus for creating a rhythm pattern by making reference to a given rhythm pattern, the apparatus comprising:

a rhythm pattern supplier which supplies a rhythm pattern piece;

a storer which stores plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a detector which detects, among said first plural groups of rhythm patterns, a rhythm pattern which is identical with said supplied pattern;

a reader which selectively reads out a rhythm pattern from said second rhythm pattern attendant to the group to which said detected rhythm pattern belongs; and a rhythm pattern producer which produces a length of rhythm pattern which assumes contrastiveness to the supplied rhythm pattern based on said read-out rhythm pattern from said reader.

10. A method for creating a melody using a computer including a storage device, the method comprising:

a step of supplying a motif melody piece;

a step of analyzing said supplied motif melody piece to extract pitch characteristics and a rhythm pattern of said supplied motif melody piece, said extracted rhythm pattern consisting of a series of rhythmic alignment of note time points including skeleton note time points having primary importance in view of rhythm beats and non-skeleton note time points having secondary importance in view of rhythm beats;

a step of imparting note pitches to said skeleton note time points in said extracted rhythm pattern, respectively, according to said extracted pitch characteristics to make pitch imparted skeleton notes, and imparts note pitches to said non-skeleton note time points in said extracted rhythm pattern, respectively, according to musical grammar making reference to the pitch imparted skeleton notes to make pitch imparted non-skeleton notes; and a step of combining said pitch imparted skeleton notes and said pitch imparted non-skeleton notes to produce a length of melody.

11. A method for creating a melody using a computer including a storage device, the method comprising:

a step of supplying a motif melody piece;

a step of analyzing said supplied motif melody piece to extract pitch characteristics and a rhythm pattern of said supplied motif melody piece, said rhythm pattern consisting of a series of rhythmic alignment of note time points;

a step of creating a rhythm pattern being similar to said extracted rhythm pattern and consisting of a series of rhythmic alignment of note time points including skeleton note time points having primary importance in view of rhythm beats and non-skeleton note time points having secondary importance in view of rhythm beats;

a step of imparting note pitches to said skeleton note time points in said similar rhythm pattern, respectively, according to said extracted pitch characteristics to make pitch imparted skeleton notes, and imparting note pitches to said non-skeleton note time points in said similar rhythm pattern, respectively, according to musical grammar making reference to the pitch imparted skeleton notes to make pitch imparted non-skeleton notes; and a step of combining said pitch imparted skeleton notes and said pitch imparted non-skeleton notes to produce a length of melody.

12. A method for creating a melody using a computer including a storage device, the method comprising:

a step of supplying a motif melody piece;

a step of analyzing said supplied motif melody piece to extract a rhythm pattern of said supplied motif melody piece, said rhythm pattern consisting of a series of rhythmic alignment of note time points;

a step of creating a rhythm pattern being contrastive to said extracted rhythm pattern and consisting of a series of rhythmic alignment of note time points including skeleton note time points having primary importance in view of rhythm beats and non-skeleton note time points having secondary importance in view of rhythm beats;

a step of providing pitch information deciding pitches to be imparted to said skeleton notes;

a step of imparting note pitches to said skeleton note time points in said contrastive rhythm pattern, respectively, according to said provided pitch information to make pitch imparted skeleton notes, and imparting note pitches to said non-skeleton note time points in said contrastive rhythm pattern, respectively, according to musical grammar making reference to the pitch imparted skeleton notes to make pitch imparted non-skeleton notes; and a step of combining said pitch imparted skeleton notes and said pitch imparted non-skeleton notes to produce a length of melody.

13. A method for creating a melody using a computer including a storage device, the method comprising:

a step of supplying a motif melody piece;

a step of analyzing said supplied motif melody piece to extract a rhythm pattern of said supplied motif melody piece;

a step of storing plural groups of rhythm patterns in which each one group contains a plurality of rhythm patterns which are similar to each other;

a step of detecting, among said plural groups of rhythm patterns, a rhythm pattern which is identical with said extracted rhythm pattern;

a step of selectively reading out any other rhythm pattern than the detected rhythm pattern from the rhythm pattern group to which said detected rhythm pattern belongs; and a step of producing a length of melody which assumes similarity to the melody motif based on said read-out rhythm pattern at said step of reading.

14. A method for creating a melody using a computer including a storage device, the method comprising:

a step of supplying a motif melody piece;

a step of analyzing said supplied motif melody piece to extract a rhythm pattern of said supplied motif melody piece;

a step of storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a step of detecting, among said first plural groups of rhythm patterns, a rhythm pattern which is identical with said extracted rhythm pattern;

a step of selectively reading out a rhythm pattern from said second rhythm pattern attendant to the group to which said detected rhythm pattern belongs; and a step of producing a length of melody which assumes contrastiveness to the melody motif based on said read-out rhythm pattern at said step of reading.

15. A method for creating a rhythm pattern using a computer including a storage device, the method comprising:

a step of supplying a rhythm pattern piece;

a step of storing plural groups of rhythm patterns in which each one group contains a plurality of rhythm patterns which are similar to each other;

a step of detecting, among said plural groups of rhythm patterns, a rhythm pattern which is identical with said supplied rhythm pattern;

a step of selectively reading out any other rhythm pattern than the detected rhythm pattern from the rhythm pattern group to which said detected rhythm pattern belongs; and a step of producing a length of rhythm pattern which assumes similarity to the supplied rhythm pattern based on said read-out rhythm pattern at said step of reading.

16. A method for creating a rhythm pattern using a computer including a storage device, the method comprising:

a step of supplying a rhythm pattern piece;

a step of storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a step of detecting, among said first plural groups of rhythm patterns, a rhythm pattern which is identical with said supplied pattern;

a step of selectively reading out a rhythm pattern from said second rhythm pattern attendant to the group to which said detected rhythm pattern belongs; and a step of producing a length of rhythm pattern which assumes contrastiveness to the supplied rhythm pattern based on said read-out rhythm pattern at said step of reading.

17. A storage medium storing a program that is executable by a computer, the program comprising:

a module for supplying a motif melody piece;

a module for analyzing said supplied motif melody piece to extract pitch characteristics and a rhythm pattern of said supplied motif melody piece, said extracted rhythm pattern consisting of a series of rhythmic alignment of note time points including skeleton note time points having primary importance in view of rhythm beats and non-skeleton note time points having secondary importance in view of rhythm beats;

a module for imparting note pitches to said skeleton note time points in said extracted rhythm pattern, respectively, according to said extracted pitch characteristics to make pitch imparted skeleton notes, and imparts note pitches to said non-skeleton note time points in said extracted rhythm pattern, respectively, according to musical grammar making reference to the pitch imparted skeleton notes to make pitch imparted non-skeleton notes; and a module for combining said pitch imparted skeleton notes and said pitch imparted non-skeleton notes to produce a length of melody.

18. A storage medium storing a program that is executable by a computer, the program comprising:

a module for supplying a motif melody piece;

a module for analyzing said supplied motif melody piece to extract pitch characteristics and a rhythm pattern of said supplied motif melody piece, said rhythm pattern consisting of a series of rhythmic alignment of note time points;

a module for creating a rhythm pattern being similar to said extracted rhythm pattern and consisting of a series of rhythmic alignment of note time points including skeleton note time points having primary importance in view of rhythm beats and non-skeleton note time points having secondary importance in view of rhythm beats;

a module for imparting note pitches to said skeleton note time points in said similar rhythm pattern, respectively, according to said extracted pitch characteristics to make pitch imparted skeleton notes, and impairing note pitches to said non-skeleton note time points in said similar rhythm pattern, respectively, according to musical grammar making reference to the pitch imparted skeleton notes to make pitch imparted non-skeleton notes; and a module for combining said pitch imparted skeleton notes and said pitch imparted non-skeleton notes to produce a length of melody.

19. A storage medium storing a program that is executable by a computer, the program comprising:

a module for supplying a motif melody piece;

a module for analyzing said supplied motif melody piece to extract a rhythm pattern of said supplied motif melody piece, said rhythm pattern consisting of a series of rhythmic alignment of note time points;

a module for creating a rhythm pattern being contrastive to said extracted rhythm pattern and consisting of a series of rhythmic alignment of note time points including skeleton note time points having primary importance in view of rhythm beats and non-skeleton note time points having secondary importance in view of rhythm beats;

a module for providing pitch information deciding pitches to be imparted to said skeleton notes;

a module for imparting note pitches to said skeleton note time points in said contrastive rhythm pattern, respectively, according to said provided pitch information to make pitch imparted skeleton notes, and imparting note pitches to said non-skeleton note time points in said contrastive rhythm pattern, respectively, according to musical grammar making reference to the pitch imparted skeleton notes to make pitch imparted non-skeleton notes; and a module for combining said pitch imparted skeleton notes and said pitch imparted non-skeleton notes to produce a length of melody.

20. A storage medium storing a program that is executable by a computer, the program comprising:

a module for supplying a motif melody piece;

a module for analyzing said supplied motif melody piece to extract a rhythm pattern of said supplied motif melody piece;

a module for storing plural groups of rhythm patterns in which each one group contains a plurality of rhythm patterns which are similar to each other;

a module for detecting, among said plural groups of rhythm patterns, a rhythm pattern which is identical with said extracted rhythm pattern;

a module for selectively reading out any other rhythm pattern than the detected rhythm pattern from the rhythm pattern group to which said detected rhythm pattern belongs; and a module for producing a length of melody which assumes similarity to the melody motif based on said read-out rhythm pattern by said module for reading.

21. A storage medium storing a program that is executable by a computer, the program comprising:

a module for supplying a motif melody piece;

a module for analyzing said supplied motif melody piece to extract a rhythm pattern of said supplied motif melody piece;

a module for storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a module for detecting, among said first plural groups of rhythm patterns, a rhythm pattern which is identical with said extracted rhythm pattern;

a module for selectively reading out a rhythm pattern from said second rhythm pattern attendant to the group to which said detected rhythm pattern belongs; and a module for producing a length of melody which assumes contrastiveness to the melody motif based on said read-out rhythm pattern by said module for reading.

22. A storage medium storing a program that is executable by a computer, the program comprising:

a module for supplying a rhythm pattern piece;

a module for storing plural groups of rhythm patterns in which each one group contains a plurality of rhythm patterns which are similar to each other;

a module for detecting, among said plural groups of rhythm patterns, a rhythm pattern which is identical with said supplied rhythm pattern;

a module for selectively reading out any other rhythm pattern than the detected rhythm pattern from the rhythm pattern group to which said detected rhythm pattern belongs; and a module for producing a length of rhythm pattern which assumes similarity to the supplied rhythm pattern based on said read-out rhythm pattern by said module for reading.

23. A storage medium storing a program that is executable by a computer, the program comprising:

a module for supplying a rhythm pattern piece;

a module for storing plural groups of rhythm patterns in which each one group contains a first plurality of rhythm patterns which are similar to each other and, attendant to the first plurality of rhythm patterns, at least one second rhythm pattern which is contrastive to the first plurality of rhythm patterns;

a module for detecting, among said first plural groups of rhythm patterns, a rhythm pattern which is identical with said supplied pattern;

a module for selectively reading out a rhythm pattern from said second rhythm pattern attendant to the group to which said detected rhythm pattern belongs; and a module for producing a length of rhythm pattern which assumes contrastiveness to the supplied rhythm pattern based on said read-out rhythm pattern by said module for reading.

* * * * *